US005078088A

United States Patent [19]

Nishikawa

[11] Patent Number: 5,078,088

[45] Date of Patent: Jan. 7, 1992

[54] ROLLER TYPE LIQUID DEVELOPING APPARATUS

[75] Inventor: Masaji Nishikawa, Hachioji, Japan

[73] Assignee: Olympus Optical Co., Ltd., Tokyo, Japan

[21] Appl. No.: 592,669

[22] Filed: Oct. 4, 1990

[30] Foreign Application Priority Data

| | | | |
|---|---|---|---|
| Oct. 11, 1989 | [JP] | Japan | 1-264248 |
| Apr. 5, 1990 | [JP] | Japan | 2-91111 |
| Apr. 12, 1990 | [JP] | Japan | 2-97238 |
| Apr. 21, 1990 | [JP] | Japan | 2-105905 |
| May 2, 1990 | [JP] | Japan | 2-116561 |
| Jul. 9, 1990 | [JP] | Japan | 2-180780 |

[51] Int. Cl.[5] ..... G03G 15/10

[52] U.S. Cl. ..... 118/659; 355/256

[58] Field of Search ..... 355/256, 257; 118/659, 118/660, 661; 430/117

[56] References Cited

U.S. PATENT DOCUMENTS

| | | | |
|---|---|---|---|
| 3,830,199 | 8/1974 | Saito et al. | 118/659 X |
| 3,875,581 | 4/1975 | Yamashita et al. | 355/256 X |
| 3,905,332 | 9/1975 | Sawada et al. | 118/661 |
| 3,907,423 | 9/1975 | Hayashi et al. | 355/256 |
| 3,974,554 | 8/1976 | Fantuzzo | 118/659 X |
| 4,102,306 | 7/1978 | Ohta | 118/661 X |
| 4,299,902 | 11/1981 | Soma et al. | 118/659 X |
| 4,454,833 | 6/1984 | McChesney et al. | 355/256 X |
| 4,545,326 | 10/1985 | Carl | 118/660 |
| 4,733,273 | 3/1988 | Lloyd | 355/256 |
| 4,878,090 | 10/1989 | Lunde | 355/256 |

FOREIGN PATENT DOCUMENTS

| | | |
|---|---|---|
| 51-43783 | 11/1976 | Japan . |
| 52-25153 | 6/1977 | Japan . |
| 62-187867 | 8/1987 | Japan . |

*Primary Examiner*—A. T. Grimley
*Assistant Examiner*—Robert Beatty
*Attorney, Agent, or Firm*—Frishauf, Holtz, Goodman & Woodward

[57] ABSTRACT

A roller type liquid developing apparatus includes a developing solution tank for storing a developing solution in which charged fine color particles are dispersed, a developing head for applying the developing solution stored in the developing tank to a sheet-like recording medium so as to develop an electrostatic latent image formed on the sheet-like recording medium, and a suction pump for pumping up the developing solution from the developing solution tank and supplying the solution into the developing head by a negative pressure effect, and subsequently circulating the developing solution into the developing solution tank. The developing head includes a rod-like base, a developing slit constituted by an elongated opening formed in a surface of the rod-like base which corresponds to the sheet-like recording medium and having a length smaller than a width of the sheet-like recording medium, a hollow portion, formed to be continuous with the developing slit, for receiving the developing solution from the developing solution tank, and a developing roller which is arranged in the hollow portion so as to be rotated while the outer surface of the developing roller opposes an opening end of the developing slit and is capable of carrying the developing solution on the outer surface. In addition, a control means for controlling the rotation speed of the developing roller during and after developing a latent image is disclosed.

17 Claims, 24 Drawing Sheets

ROLLER TYPE LIQUID DEVELOPING APPARATUS

BACKGROUND OF THE INVENTION

1. Field of the Invention

The present invention relates to a developing apparatus which is arranged to oppose a sheet-like recording medium having an electrostatic latent image formed thereon so as to cause a developing solution in which charged fine color particles (toner particles) are dispersed to act on a surface of the recording medium on which the electrostatic latent image is formed.

More particularly, the present invention relates to a roller type liquid developing apparatus of a negative pressure suction scheme, in which a developing solution is circulated/supplied to a developing head by using a negative pressure suction means, and an electrostatic latent image formed on a recording medium is developed by rotating a developing roller which is designed to carry the developing solution on its surface and to oppose the recording medium through a very small gap.

2. Description of the Related Art

For example, U.S. Pat. No. 4454833 discloses a developing apparatus wherein a rotatably supported developing roller is arranged to oppose a recording medium having an electrostatic latent image formed thereon through a very small gap, and the roller is rotated while at least a part of the roller is dipped in a developing solution so as to cause a developing solution layer carried on the developing roller surface to act on the electrostatic latent image, thus performing a developing operation.

In addition, for example, Published Examined Japanese Utility Model Application No. 52-25153 discloses a liquid developing apparatus of a negative pressure suction scheme wherein a developing solution is circulated/supplied to a developing head by using negative pressure suction of a suction pump.

In the roller type liquid developing apparatus disclosed in U.S. Pat. No. 4454833, a large amount of developing solution can be supplied while the developing roller is caused to approach a recording sheet surface so as to apply a strong electromagnetic effect onto the recording sheet surface. With this arrangement, a high developing efficiency can be obtained. However, a large amount of residual developing solution adheres to the surface of the recording sheet after the developing operation. For this reason, it is difficult to quickly and completely remove this residual solution by using only a developing solution removing roller. Consequently, in order to remove the developing solution adhering to the developing solution removing roller itself so as not to cause it to adhere to the recording sheet surface again, a considerable amount of recording sheets must be kept fed to sufficiently spread the residual developing solution on the recording sheet surface. Therefore, recording sheets are wastefully consumed in large quantities, posing an economical problem. In addition, since the outer surface of the developing roller as the upper surface of the developing head is externally exposed, a developing solution tends to be scattered outside. The surroundings inevitably tend to be smeared.

In U.S. Pat. No. 4454833, a blade for the developing roller is designed to support an elastic sheet, such as a polyurethane sheet or a polyester sheet, on its one end and to urge its other end against the surface of the developing roller. When the developing apparatus having such an arrangement is to be applied to a recording apparatus using a recording sheet having a width of about 1 meter, such as a color electrostatic plotter, a long developing head is required. For this reason, it is difficult to uniformly support the above-mentioned blade against the outer surface of the developing roller. Especially, it is not easy to ensure an accurate operation of the blade by causing it to follow the deflection of such a long developing roller.

If the developing roller is off-centered or bent due to such deflection, the developing gap varies to greatly influence the developing performance. In order to manufacture a long developing roller without deflection, its diameter and rigidity must be increased. Then, the developing head is increased in size and weight, and it is very difficult to process such a developing head. This presents an obstacle in realizing a small roller type liquid developing apparatus which is easy to manufacture.

In the roller type liquid developing apparatus disclosed in U.S. Pat. No. 4454833, the developing roller has a smooth surface without an uneven portion. For this reason, it is sometimes difficult to efficiently attach a developing solution to the surface of the developing roller. According to a proposed means for solving such a problem, a spiral groove or grooves parallel to the roller axis are formed in the surface of the developing roller. However, with the above-mentioned means, developing streaks are sometimes formed.

In the liquid developing apparatus of the negative pressure suction scheme disclosed in Published Examined Japanese Utility Model Application No. 52-25153, since a negative pressure acts on a developing slit and the like during a developing operation, a developing solution on a sheet-like recording medium is sucked/removed. Such an effect serves to suppress the developing solution from scattering outside, thus reducing the possibility of smearing. However, if the developing operation is completed, and the suction pump is stopped, the above-mentioned effect is lost. Since some developing solution is attached to the surface of the sheet-like recording medium located at the developing slit at this time, if the medium is moved in this state, the developing solution will be spread over the surface of the medium. As a result, the surface of the recording medium or those of the convey rollers are smeared with the solution.

In order to solve such a problem, another means, e.g., a special suction drying head, must be arranged to remove a developing solution attached to a recording surface in a stop state of the pump. Another problem is that an excessively large amount of developing solution is attached to a recording medium and carried away at the end of developing, although a very small amount of developing solution is carried away by the recording medium in the process of developing.

SUMMARY OF THE INVENTION

It is the first object of the present invention to provide a roller type liquid developing apparatus having a very high developing efficiency, in which a very small amount of a developing solution is left and attached to a surface of a recording medium upon completion of developing, and there is no possibility that a developing solution is scattered during a developing operation to smear the surroundings.

It is the second object of the present invention to provide a roller type liquid developing apparatus including a developing head which can be replaced with a new one even though it is housed in a sealed case member, in which a blade support means has a very simple structure, a blade can properly follow the deflection and the like of a developing roller, only a small space is occupied by the blade and the blade support means, and the blade has a long service life.

It is the third object of the present invention to provide a roller type liquid developing apparatus including a developing roller having a small diameter, which is small in size and weight, is easy to process, can reduce the manufacturing cost, can simplify associated facilities, and can reduce the size of the overall apparatus.

It is the fourth object of the present invention to provide a roller type liquid developing apparatus which can reduce developing streaks and has high developing performance.

It is the fifth object of the present invention to provide a roller type liquid developing apparatus having a small, simple arrangement, which can remove a developing solution from a surface of a sheet-like recording medium by using a developing head itself upon completion of developing without a special developing solution removing means.

It is the sixth object of the present invention to provide a roller type liquid developing apparatus, which allows a suction/drying effect to stably act on a recording medium even after developing, requires no special drying unit, realizes a small, simple arrangement, and can reduce wasteful consumption of the recording medium and a developing solution.

In order to achieve the first object, according to the present invention, there are provided the following means:

(1) a means comprising a developing solution tank for storing a developing solution, a developing head for applying the developing solution stored in the developing solution tank to a sheet-like recording medium, a suction pump for sucking/introducing the developing solution from the developing solution tank into the developing head by a negative pressure suction effect, and piping tubes for connecting these three components to each other, wherein the developing head includes a rod-like base, a developing slit constituted by an elongated opening having a length smaller than the width of the sheet-like recording medium and formed in a surface of the rod-like base which opposes the sheet-like recording medium, a hollow portion formed to be continuous with the developing slit and to receive the developing solution from the developing solution tank, and a developing roller housed in the hollow portion and designed to be rotated with its outer surface facing the opening end of the developing slit;

(2) in addition to the means (1), a liquid suction slit is formed in the upper surface of the rod-like base in such a manner that it is adjacent to the developing slit and its bottom portion is connected to the hollow portion and other negative pressure portions through a communicating hole having a small sectional area; and (3) in addition to the means (2), a separating slit open to the air is formed between the developing slit and the liquid suction slit.

With the above-described means, the following effects can be obtained.

The developing solution is sucked/introduced into the hollow portion in the rod-like base of the developing head by a negative pressure. Owing to the presence of the developing roller serving as a developing electrode, a very small gap is defined between the developing roller partly opposing the developing slit and the recording medium, and a strong developing electrode effect is generated. Upon rotation of the developing roller, the developing solution is forcibly supplied into the gap. As a result, a high developing efficiency can be obtained.

Since the developing slit portion of the developing head is maintained at a negative pressure during a developing operation, when the recording medium passes through over the developing head, an excess developing solution on the recording medium is sucked/removed by the developing head. For this reason, almost no residual developing solution is attached to the sheet-like recording medium after the developing operation.

In addition, since the developing slit of the developing head is kept at a negative pressure, there is no possibility that the developing solution flows out from the developing head, thus preventing smearing of the surroundings due to scattering of the developing solution.

In order to achieve the second object, according to the present invention, there is provided a means comprising:

a developing roller constituted by a magnetic member rotatably arranged in a hollow case, a blade constituted by a strip-like sheet obtained by dispersing magnetic particles in an elastic member, the strip-like sheet being magnetized to be attracted and held to and on the surface of the developing roller by a magnetic attracting force, and a blade stopper arranged between the position of the downstream end portion of a developing portion in the rotating direction of the developing roller and the position at which the surface of the developing roller escapes from a developing solution surface to move toward the upstream end portion of the developing portion.

With the above-described means, the following effects can be obtained.

The blade is held on the surface of the developing roller by a magnetic attracting force, and is positioned by the stopper. Since the blade is flexible, it fits the surface of the developing roller very well and is drawn thereto. For this reason, when this blade is applied to a long developing head, it can reliably remove a developing solution.

If the roller is rotated in a direction opposite to the direction during a developing operation, the blade can be moved to an arbitrary position while it is drawn to the roller surface. Therefore, replacement or the like can be easily performed by moving the blade to a position where such an operation can be easily performed.

In order to achieve the third object, according to the present invention, there is provided a means comprising:

a developing roller constituted by a magnetic member, a hollow case for housing the developing roller and storing a developing solution, and a magnet type roller position regulating member supported in the hollow case and positioned to attract an outer surface of the developing roller, wherein the developing roller is attracted to the magnet to urge the outer surface of the developing roller against a regulating surface, and the developing roller is rotated in this state.

With the above-described means, the following effects can be obtained.

The developing roller, which bends when supported by only bearings at the two ends, is urged against the position regulating surface of the roller position regulating member by the attracting force of the magnet. The developing roller is then rotated while it is positioned against the position regulating surface. This prevents changes in developing gap caused when the roller surface position varies depending on the rotational angle of the developing roller.

In order to achieve the fourth object, according to the present invention, there is provided a means comprising:

a spiral groove formed in a surface of a developing roller base in such a manner that a surface of a sheet-like recording medium is supported by a top portion of the groove. The sectional shape of the spiral groove is designed such that "a size l1 of the sheet-like recording medium in a direction parallel to the roller axis" within a range in which the distance between the inner wall of the groove and the surface of the sheet-like recording medium is 0.2 mm or less is set to be half or more of "a groove pitch p of the developing roller in the axial direction".

With the above-described means, the following effect can be obtained.

A large potential gradient is formed in the region in which the distance between the sheet-like recording medium and the surface of the developing roller serving as a developing electrode is 0.2 mm or less, and toner particles in a developing solution in the region exhibit high-speed electrophoresis. As a result, developing with a high image density is performed at high speed. A slight decrease in image density occurs in a region adjacent to the above range, in which the developing speed is gradually decreased. However, this region is set to be narrow and hence serves to form a developed image which is substantially free from irregular developing. In addition, upon generation of an inclination angle in a high-density region due to the effect of the spiral groove, the area of the high-density region is increased. This prevents irregular developing which may practically hinder normal recording.

In order to achieve the fifth embodiment, according to the present invention, there is provided a means comprising:

a developing solution tank for storing a developing solution in which charged fine color particles are dispersed, a developing head constituted by a hollow case and a developing roller, the hollow case having a developing solution supply port and a discharge port formed in a bottom portion thereof and a developing slit formed in an upper surface thereof, and the developing roller being arranged in the hollow case to cause an outer surface thereof having a spiral groove to oppose a sheet-like recording medium through a small gap and to be rotatable while the outer surface thereof opposes an opening end of the developing slit, whereby the developing solution stored in the developing solution tank to a recording medium and developing an electrostatic latent image formed on the recording medium, a suction pump for pumping up the developing solution from the developing solution tank into the developing head by a negative pressure, and subsequently returning the developing solution to the developing solution tank, a developing roller driving unit for rotating the developing roller in the developing head, a recording medium feed unit for conveying the sheet-like recording medium so as to cause the medium to pass through over the developing head, and control means for controlling the suction pump, the developing roller driving unit, and the recording medium feed unit, wherein the control means controls rotation of the developing roller in a mode different from a mode during a developing operation with the suction pump being operated so as to remove the developing solution from the surface of the developing roller after the developing operation, and performs control to convey the sheet-like recording medium, to remove the developing solution from the recording medium surface, and to dry a recording surface of the sheet-like recording medium.

With the above-described means, the following effect can be obtained.

Upon developing, the developing roller supplies no new developing solution to a surface of a sheet-like recording medium, and carries a developing solution away from a solution pool formed on a developing portion. In order to achieve such an effect, grooves are formed in the surface of the developing roller along its circumferential direction. With this arrangement, the area of projections on the surface of the developing roller which are brought into contact with a sheet-like recording medium is reduced, thus ensuring quick removal of a developing solution. Therefore, a solution pool on the developing portion is removed, and the surface of the developing roller in contact with the sheet-like recording medium is kept dry. Since the sheet-like recording medium is conveyed while the developing slit is maintained at a negative pressure, the developing solution on the surface of the sheet-like recording medium is also sucked/removed by the effect of the negative pressure. In this manner, the developing head itself can be caused to serve as a roller for removing a developing solution attached to a surface of a sheet-like recording medium.

In order to achieve the sixth object, according to the present invention, there is provided the following means.

A means for forcibly removing a developing solution attached to the surface of the developing roller is arranged. After a developing operation, while an operating portion of the developing solution forcibly removing means is exposed on a solution surface, the developing roller is rotated in a direction to move the roller surface to a developing portion from this portion without passing under the solution surface. Meanwhile, a suction pump is continuously operated during a period in which a developing solution pool is removed from the developing portion and a portion of the sheet-like recording medium to which a developing solution is attached completely passes through a developing head portion.

With the above-described means, the following effects can be obtained.

After a developing operation, the developing roller serves to remove a developing solution pool from a developing region, and a developing solution on a sheet-like recording medium is removed by the developing head kept at a negative pressure. For this reason, a suction/drying effect stably acts on a recording medium even after the developing operation as well as in the process of developing. Therefore, no special drying unit is required, and a small, simple arrangement can be realized. In addition, wasteful consumption of a recording medium and a developing solution can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 and 2 show the first embodiment of the present invention, in which FIG. 1 is a view showing an overall arrangement, and FIG. 2 is a sectional view showing a structure of a developing head;

FIGS. 3 and 4 show the second embodiment of the present invention, in which FIG. 3 is a sectional view showing a structure of a developing head, and FIG. 4 is a sectional view showing a structure of a developing head obtained by partly modifying the developing head in FIG. 3;

FIGS. 9 and 10 show the sixth embodiment of the present invention, in which FIG. 9 is an exploded perspective view showing a structure of a developing head, and FIG. 10 is a sectional view showing the developing head;

FIGS. 24 to 28 are views showing the thirteenth embodiment invention, in which FIGS. 24 and 25 are views showing a schematic arrangement of an apparatus, FIGS. 26A, 26B, 26C and 27 are views showing electrophoresis near the top portion of a spiral groove, FIG. 28 is a sectional view showing a modification of the spiral groove;

FIGS. 36 to 38 show the sixteenth embodiment of the present invention, in which FIG. 36 is a view showing an overall arrangement, FIG. 37 is a sectional view showing a spiral groove, and FIG. 38 is a timing chart showing a sequence of operations;

FIGS. 39 and 40 show the seventeenth embodiment of the present invention, in which FIG. 39 is a sectional view showing a main part of the embodiment, and FIG. 40 is a timing chart showing a sequence of operations;

DETAILED DESCRIPTION OF THE PREFERRED EMBODIMENTS

First Embodiment

Figure 1:
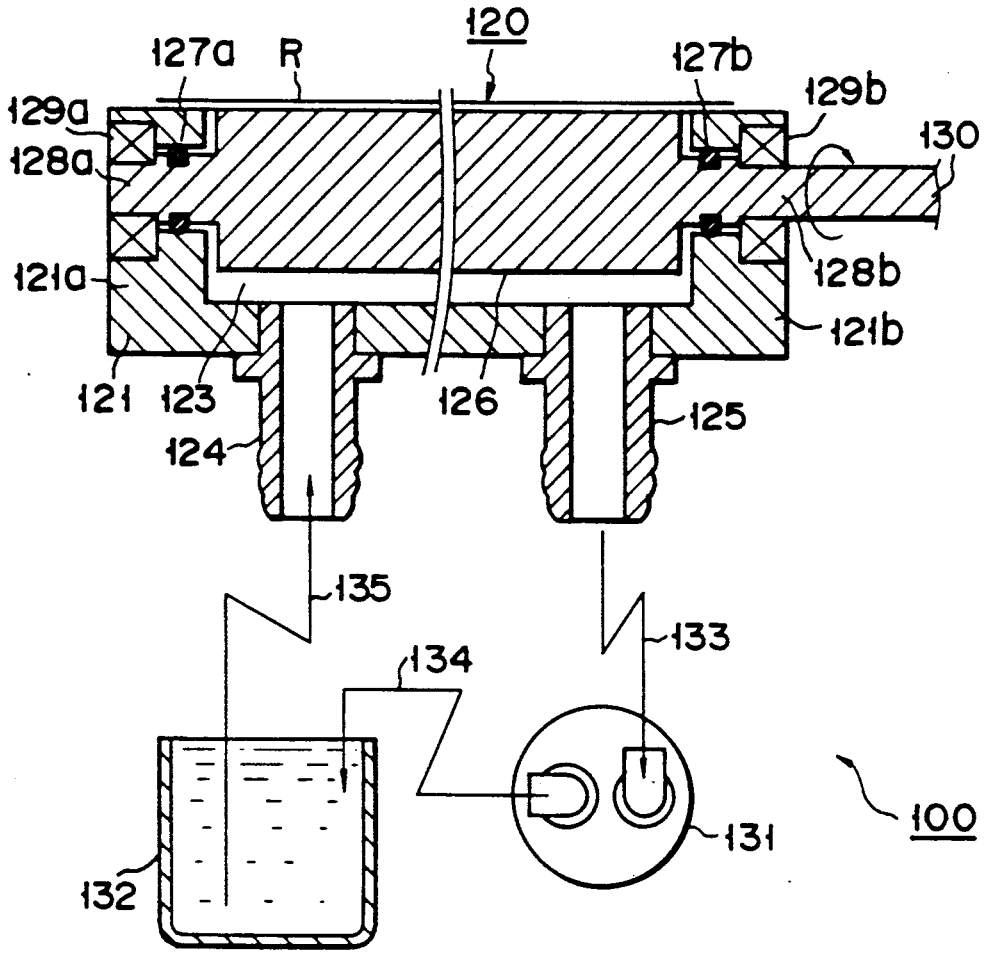
Figure 2:
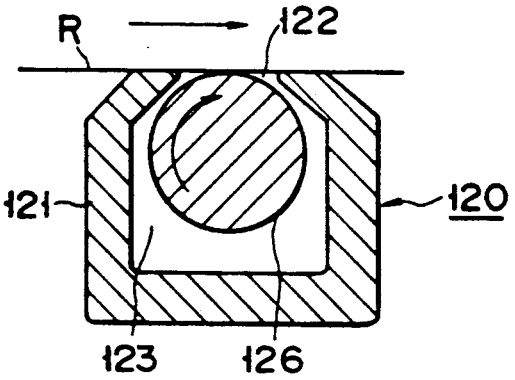

FIGS. 1 and 2 show the first embodiment of the present invention. FIG. 1 is a view showing an overall arrangement of an apparatus 100. FIG. 2 is a sectional view showing a structure of a developing head 120.

Referring to FIGS. 1 and 2, reference numeral 120 denotes the developing head; 121, a rod-like base; 122, a developing slit; 123, a hollow portion; 124, an inflow joint; 125, an outflow joint; 126, a developing roller; 127*a* and 127*b*, bearing mechanisms having O-rings, respectively; 128*a* and 128*b*, roller shafts; 129*a* and 129*b*, bearings; 130, a driving shaft; 131, a suction pump; 132, a developing solution tank; and 133 to 135, piping tubes. Reference symbol R denotes a sheet-like recording medium.

The rod-like base 121 has the developing slit 122 formed in its upper surface. The developing slit 122 is constituted by a long opening having a length smaller than the width of the sheet-like recording medium R. In addition, the rod-like base 121 has the hollow portion 123 therein. The hollow portion 123 is continuous with the developing slit 122. The hollow portion 123 has two ends sealed with sealing walls 121*a* and 121*b* so as to receive a developing solution in the developing solution tank 132. The developing roller 126 is housed in the hollow portion 123. The developing roller 126 is arranged to be driven to rotate while its outer surface opposes the developing slit 122. The uppermost portion of the developing roller 126 coincides with the upper end face of the developing head 120. The upper surface of each of the two side edge portions of the rod-like base 121, which define the developing slit 122, has a width of at least 2 to 3 mm so that a sufficient seal effect can be obtained when the suction pump 131 is operated with the sheet-like recording medium R covering the developing slit 122. Gears, pulleys, couplings, and the like are fitted in and on the driving shaft 130 formed on the extended end portion of the shaft 128*b* of the developing roller 126, although they are not shown. With this arrangement, power from a power source is transmitted to the driving shaft 130.

The outflow joint 125 arranged at a bottom portion of the rod-like base 121 is connected to the suction pump 131 through the piping tube 133. The suction pump 131 is connected to the developing solution tank 132 through the piping tube 134. The developing solution tank 132 is connected to the inflow joint 124 through the piping tube 135.

The apparatus having the above-described arrangement is operated in the following manner. When the suction pump 131 is operated while the sheet-like recording medium R having a width slightly larger than the length of the developing slit 122 is placed on the upper surface of the developing head 120, the interior of the hollow portion 123 is set at a negative pressure. For this reason, the sheet-like recording medium R is drawn to the upper surface of the developing head 120. When the sheet-like recording medium R is drawn, the negative pressure in the hollow portion 123 is further increased. The developing solution is then sucked up from the developing solution tank 132 by the negative pressure and is introduced into the hollow portion 123. With this operation, the hollow portion 123 is filled with the developing solution. Thereafter, the developing solution is returned to the developing solution tank 132 through the suction pump 131.

While the sheet-like recording medium R is moved in a direction indicated by an arrow in FIG. 2 in this state, the developing roller 126 is rotated in the same direction. With this operation, the developing solution keeps acting on the sheet-like recording medium R while the sheet-like recording medium R passes over the developing slit 122.

At this time, the gap between the sheet-like recording medium R and the developing roller 126 in the middle of the slit 122 is very small. If, therefore, the developing roller 126 is made of a metal, the roller 126 exhibits a strong effect of a developing electrode. After the developing operation, dispersed toner particles in the developing solution are consumed and reduced. However, the developing solution having the reduced toner is carried away, and a new solution is kept supplied by the rotation of the developing roller 126.

It is not essential that the rotating direction of the developing roller 126 coincides with the convey direction of the sheet-like recording medium R as shown in FIG. 2. It is, however, preferable that these directions coincide with each other, because an increase in amount of friction between the sheet-like recording medium R and the developing roller 126 can be prevented to allow satisfactory circulatory supply of the developing solution.

Although the width of the developing slit 122 cannot be absolutely defined in consideration of the thickness of the developing roller 126, it is preferably set to be about 5 to 15 mm. An increase in width of the slit 122 enhances the drawing effect of the sheet-like recording medium R to the inside of the slit 122 by negative pressure. As in this embodiment, however, the presence of the developing roller 126 inside the slit 122 prevents such a sucking phenomenon of the sheet-like recording medium R. This prevents bending of the sheet-like recording medium R and accompanying crease due to the above-mentioned sucking phenomenon.

According to the first embodiment, there is provided a developing apparatus which can realize a high developing efficiency, and can effectively remove the developing solution from a recording sheet surface without smearing the surroundings with the solution.

In the developing apparatus of the first embodiment shown in FIGS. 1 and 2, the interior of the hollow portion 123 is kept at a negative pressure. For this reason, air leaks through a small uneven gap between the outer surface and the sheet-like recording medium R. This air leak generates an effect of removing the developing solution attached to a surface of the sheet-like recording medium R. If, however, the above-mentioned effect is not sufficient, the sheet-like recording medium R may pass through the developing head portion while the developed surface is not satisfactory dried. As a result, convey rollers may be smeared, or a recording medium surface may be smeared upon transfer of the smear.

Second Embodiment

Figure 3:
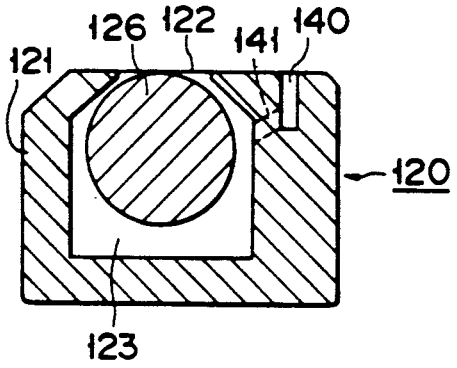

FIG. 3 shows the second embodiment of the present invention which has been made in consideration of the above situation. More specifically, this embodiment includes a liquid suction slit 140 for sucking/removing a residual developing solution on a recording medium R. As shown in FIG. 3, the liquid suction slit 140 is formed in a developing head 120 on the downstream side (right side in FIG. 3) of the moving direction of a recording medium so as to be parallel and adjacent to a developing slit 122. The liquid suction slit 140 is connected to a hollow portion 123 through a communicating hole 141 having a small sectional area. The communicating hole 141 is only required to have a sectional area corresponding to, e.g., a diameter of several millimeters, which allows air sucked from the liquid suction slit 140 to be passed through. The communicating hole 141 is preferably formed at a position near the outflow joint 125 shown in FIG. 1. If a large number of communicating holes 141 are formed, or the communicating hole 141 has a large diameter, a developing solution in the hollow portion 123 may flow into the liquid suction slit 140 due to a negative pressure balance, resulting in loss of the drying effect. Therefore, it is essential that a coupling degree by means of the communicating hole 141 is low.

Figure 4:
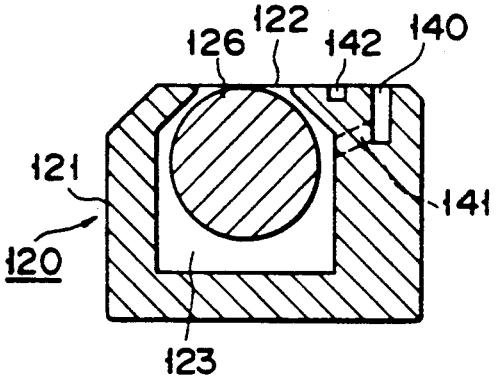

FIG. 4 shows a modification of the second embodiment, which is improved to enhance the suction/drying effect of the liquid suction slit 140. In this modification, a separation slit 142 is formed between the developing slit 122 and the liquid suction slit 140. For example, the length of the separation slit 142 is set to be larger than the width of the recording medium R so that the two ends of the slit 142 are open to the air. With the separation slit 142, air leaks to the liquid suction slit 140 occur at both the front and rear edges of the slit 140 with respect to the moving direction of the recording medium R. As a result, the suction/drying effect is enhanced.

According to the second embodiment, in addition to the effects in the first embodiment, a residual developing solution on the recording medium R can be sucked/removed by the liquid suction slit 140, thus preventing smearing of a developing solution.

The communicating hole 141 may be provided between the liquid suction slit 140 and any position on the path coupling the suction pump 131 and the hollow portion 123 for example.

As described above, in wet developing, a developing electrode is set against a recording medium R having an electrostatic latent image formed thereon through a gap, and a developing operation is performed by filling the gap with a developing solution. As the developing electrode, a developing roller may be used. In such a developing system, if a recording medium R includes a region having a strong effect of attracting toner particles in a developing solution, e.g., a solid image portion, toner particles are attracted to the region in a large amount and consumed. In this case, adhesion of a toner aggregate to the developing roller 126 hardly occurs, and hence a clean state can be maintained. In contrast to this, at a non-imaging portion, toner particles are not attracted to a recording medium. If the base sheet of the recording medium R is charged, or a bias voltage is applied thereto in order to prevent a fog, an electric field repelling the toner is formed on a recording medium surface. In such a case, a developing solution layer having a high toner density is formed on the surface of the developing roller 126. For this reason, an aggregate of toner particles is attracted to the developing roller 126. If the developing roller 126 holding the developing solution layer having a high toner density or an aggregated of toner particles acts on the non-imaging portion of the recording medium R, the toner adheres to the recording medium surface to cause a fog. As a result, a poor image is formed.

Third Embodiment

Figure 5:
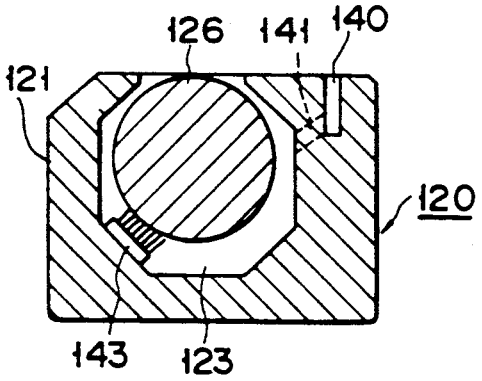
FIG. 5 is a sectional view showing the third embodiment of the present invention, specifically a structure of a developing head.

FIG. 5 shows the third embodiment of the present invention which includes a means for eliminating the above-described inconvenience. This embodiment is characterized in that a brush-like member 143 as a cleaning means is arranged in a hollow portion 123 of a rod-like base 121 to be in contact with the outer surface of a developing roller 126 so as to perform cleaning operations.

As a cleaning means, a blade consisting of, e.g., a rubber sheet, a plastic sheet, or a metal film is available other than the above-described means. This blade is urged against the outer surface of the developing roller 126. Alternatively, an elastic member consisting of a foamed rubber, a foamed plastic member, or the like may be arranged on the outer surface of the developing roller 126 in a compressed state.

According to the third embodiment, while the developing roller 126 is rotated, its outer surface is abraded by the cleaning means. With this operation, smears on the outer surface of the roller 126 are removed.

Since a negative pressure with the suction pump 131 acts on a developing head 120, a recording medium R is drawn into a developing slit 122 and is bent/deflected. As the slit width is increased, the bending amount is increased. Subsequently, the developing roller 126 and the recording medium R are brought into contact with each other. If the negative pressure is large, the contact pressure is increased. As a result, a developing solution replenishing effect by means of the developing roller 126 is weakened by the contact portion.

Fourth Embodiment

Figure 6:
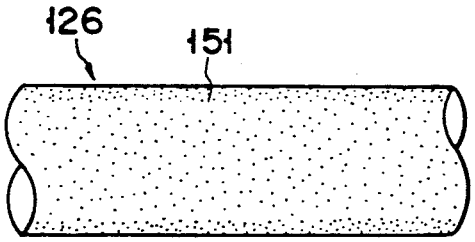
FIGS. 6 and 7 are side views showing the fourth embodiment invention, specifically portions of developing rollers respectively having uneven surfaces obtained by different rough surface processing means.
Figure 7:
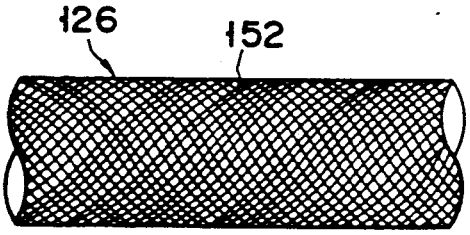

FIGS. 6 and 7 show the fourth embodiment of the present invention which is designed to eliminate the above-described inconvenience. In this embodiment, an uneven portion is formed on the surface of a developing roller 126 so as to allow a developing solution to properly flow in a developing gap portion.

FIG. 6 shows a case wherein an uneven portion 151 is formed on the surface of the developing roller 126 by sandblasting. A recording medium R normally has an uneven portion with a depth of 10 to 20 μm. In order to allow the uneven portion 151 of the developing roller 126 to effectively serve as a means for causing a developing solution to properly flow, rough surface processing is preferably performed to form the uneven portion having a depth of 100 μm or more.

FIG. 7 shows a case wherein in order to form an uneven portion having a larger depth, knurling is performed to form an uneven portion 152 on a developing roller 126. In this processing, the uneven portion 152 may have a depth of about 0.1 to 1 mm by properly selecting a knurling tool. Instead of performing the above-mentioned knurling process, a spiral groove forming process may be performed.

According to this embodiment, the uneven portion is formed on the surface of the developing roller 126. Therefore, a proper flow of a developing solution in a developing gap portion can be maintained.

Each of the developing heads 120 in the respective embodiments shown in FIGS. 1 to 7 is formed to have an envelope-like shape, which has the hollow portion 123 in its central portion. Owing to this shape, processing is not necessarily easy.

Fifth Embodiment

Figure 8:
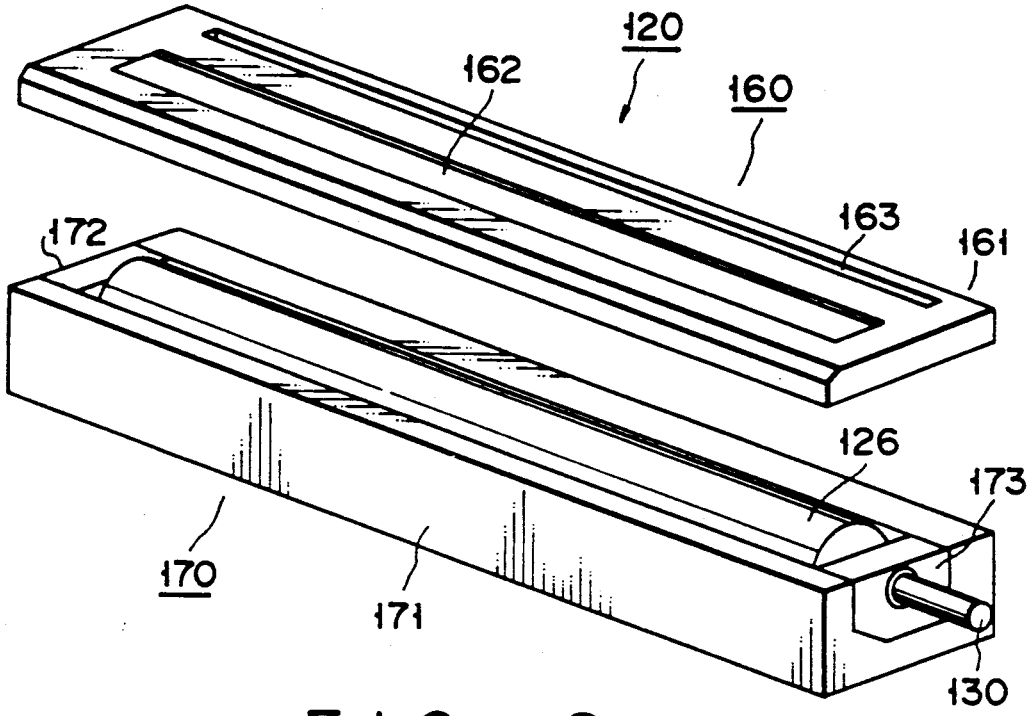
FIG. 8 is an exploded perspective view showing the fifth embodiment of the present invention, specifically a structure of developing head.

FIG. 8 shows the fifth embodiment of the present invention in which workability of a developing head 120 is improved. In this embodiment, a rod-like base is divided into upper and lower portions which are used as an integral portion. As shown in FIG. 8, an upper base 160 is obtained by forming a developing slit 162, a liquid suction slit 163, and a communicating hole (not shown) in a plate-like member 161. If the plate-like member 161 consists of a material having good abrasion resistance, such as stainless steel, only material processing is required. However, if a material having poor abrasion resistance, such as an aluminum alloy, is used, an abrasion-resistant layer is preferably formed on the surface of the material in advance by anodized aluminum formation processing, nickel plating, chromium plating, or the like.

A lower base 170 is obtained by respectively joining bearing members 172 and 173 to the two end portions of a gutter-like member 171 having a U-shaped cross-section. When the members 172 and 173 are joined, a developing roller 126 is simultaneously arranged in the lower base 170.

Joining of the upper and lower bases 160 and 170 and of the gutter-like member 171 and the bearing members 172 and 173 is to be performed by a means capable of realizing a sealed structure, such as an adhesive agent. In order to increase the mechanical strength, coupling means such as screws (not shown) are preferably used together.

According to the fifth embodiment, the manufacture of a developing head is greatly facilitated.

No significant problems are posed in the developing head of the fifth embodiment shown in FIG. 8 when its length is not excessively long. However, if the developing head is long, the upper base 160 may be deflected during processing or the like. Some means for preventing such deflection is required. Screw holes are formed in the lower surface of the plate-like member 161. The plate-like member 161 is then fixed to a jig by threadably engaging the screw holes with the screws of the jig. The slits 162 and 163 are formed in this state. With this operation, bending/deflection of the plate-like member 161 can be prevented during processing even if the member 161 is thin. It is apparent that in the manufacture of a long head, the less the amount of portions to be cut/processed, the better a result will be.

Sixth Embodiment

Figure 9:
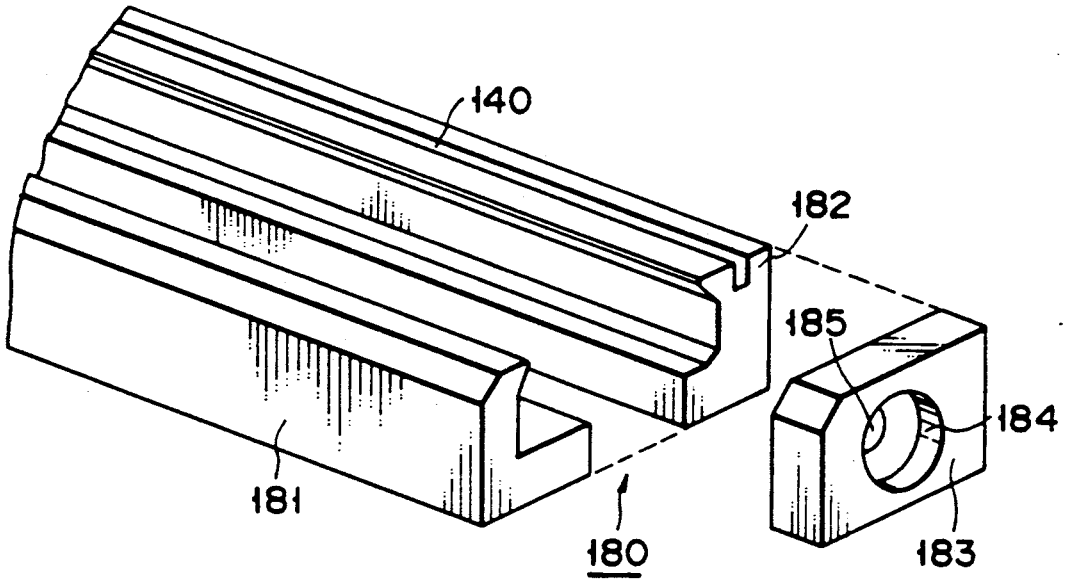
Figure 10:
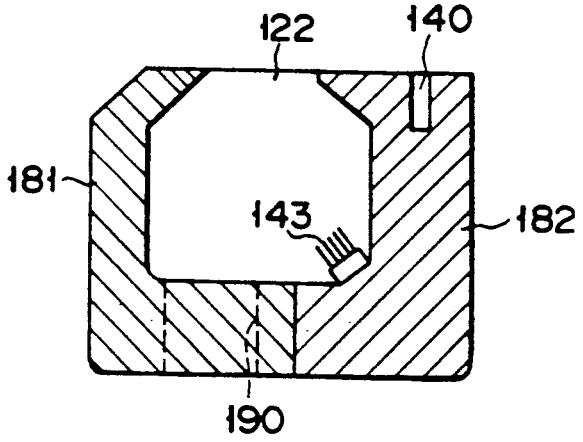

FIGS. 9 and 10 show the sixth embodiment of the present invention, in which the amount of portions to be cut/processed is reduced. As shown in FIG. 9, a molded base 180 comprises molded L-shaped members 181 and 182, and two bearing members 183 (only one of them is shown). These four members are joined together in directions parallel to dotted lines to be integrated. Reference numeral 184 denotes a bearing hole; and 185, a developing roller bearing hole.

Each of the L-shaped members 181 and 182 is a long member having a uniform cross-section and is easily formed into an elongated member free from deflection by molding such as extrusion molding of an aluminum alloy.

The L-shaped members 181 and 182 may be obtained by dividing a member having a U-shaped cross-section into equal parts, or a member formed by extrusion molding and having a cross-section equivalent to the cross-sections of the members 181 and 182 as an integral part may be used.

When the members 182 and 183 or the integrated member is to be formed by extrusion molding, a layer having good abrasion resistance is preferably coated on at least a surface to be brought into contact with a recording medium. For this purpose, surface processing, e.g., anodized aluminum formation processing, nickel plating, chromium plating, or the like is preferably performed.

Note that the member 183 serves not only as a bearing member but also as an end portion sealing member.

Referring to FIG. 10, reference numeral 190 denotes a hole for a piping tube connecting joint.

According to the sixth embodiment, since L-shaped members or a U-shaped member is used, a good resistance to external forces can be obtained. Since no cutting other than cutting of end faces is required, this embodiment is especially suitable for the formation of a long head.

Seventh Embodiment

Figure 11:
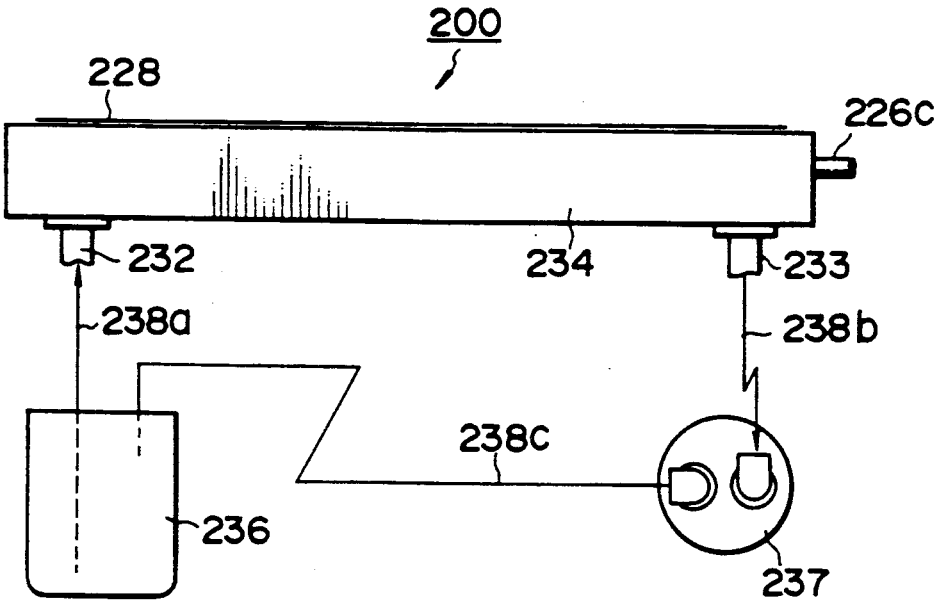
FIGS. 11 and 12 are side and sectional views showing an arrangement of the seventh embodiment of the present invention.
Figure 12:
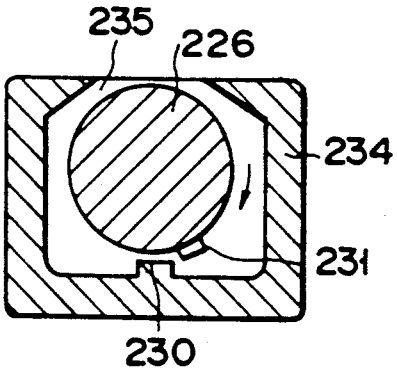

FIGS. 11 and 12 shows the seventh embodiment of the present invention. FIG. 11 is a view showing an overall arrangement of an apparatus 200. FIG. 12 is a sectional view showing a structure of a developing head 120. Referring to FIGS. 11 and 12, reference numeral 226 denotes a developing roller; 228, a sheet-like recording medium; 230, a stopper; 231, a magnetic blade; and 232, a developing solution supply port; 233, a discharge port; 234, a hollow case, 235, a developing slit; 236, a developing solution tank; 237, a suction pump; and 238*a*, 238*b*, and 238*c*, piping tubes, respectively.

The developing roller 226 is a metal roller consisting of a magnetic member and serving as a developing electrode. The developing roller 226 supports the magnetic blade 231 and is axially supported to be rotated in a direction indicated by an arrow.

The magnetic blade 231 is constituted by a sheet-like member obtained by dispersing a magnetic powder serving as a permanent magnet, such as ferrite, in a flexible material such as rubber or plastic material. More specifically, the above-mentioned member is magnetized and cut in the form of a strip. The magnetic blade 231 may be used while the magnetic member is exposed on its surface. However, in order to reduce friction resistance between the blade 231 and the surface of the developing roller 226, to improve the abrasion resistance, and to allow the blade 231 to be drawn to the developing roller surface without a gap, a non-magnetic plastic or rubber layer is preferably bonded to or coated on the surface of the magnetic blade 231. The stopper 230 extends from the inner bottom surface of the hollow case 234. The stopper 230 and the developing roller 226 define a gap through which the magnetic blade 231 cannot pass. Note that the stopper 230 may be continuously formed to be parallel to the axial direction of the developing roller 226, or may be discretely formed at intervals.

The magnetic blade 231 is placed on the developing roller 226 from an arbitrary, easily accessible position above the hollow case 234. When the developing roller 226 is rotated in the direction indicated by the arrow, the magnetic blade 231 is moved to the position of the stopper 230 and is stopped, thus positioning the blade 231. Subsequently, the blade 231 stays at the stopper position and slides on the developing roller 226. When the blade 231 is to be replaced with a new one, the developing roller 226 is rotated in the reverse direction to perform an attaching/detaching operation at an easily accessible position.

When the developing roller 226 is rotated in the direction indicated by the arrow, a developing solution adhering to its surface is moved to a developing region where the sheet-like recording medium 228 is brought into closest contact with the developing roller 226. As a result, a solution pool is formed in this region. The developing solution having a toner consumed in the developing region is moved while it adheres to the surface of the developing roller 226, and flows under the solution surface. Such a solution is not easily replaced with another solution portion due to viscosity confinement force. If this confined developing solution reaches the magnetic blade 231, the solution is forcibly removed thereby. A new developing solution is then supplied to a roller surface which passes through the blade 231. In this manner, a developing solution which has not consumed a toner is sequentially supplied to the developing effective portion, and high developing performance is maintained.

Another function of the magnetic blade 231 will be described below. When no electrostatic latent image is formed on the sheet-like recording medium 228, the magnetic blade 231 removes a developing solution having no toner consumed or a toner aggregate deposited on the developing roller surface, thus always keeping the developing roller surface in a clean state. Such an increase in density of a toner on the developing roller 226 is caused when a bias voltage is applied between the developing roller 226 and the sheet-like recording medium 228 so as to prevent a fog in a non-imaging portion, or when an electrostatic latent image charge is neutralized by a toner charge upon developing of an imaging portion, and a latent image charge and a charge having an opposite polarity confined in a conductive layer of the sheet-like recording medium 228 are dissipated. That is, the toner density is increased when the conductive layer potential is changed, and the sheet-like recording medium potential at the non-imaging portion is shifted in a direction to repel the toner. If no measures are taken against this phenomenon, a fog occurs in the non-imaging portion because of a developing solution having a high toner density.

In this embodiment, since the urging force of the magnetic blade 231 against the developing roller 226 is generated by the magnetic force of the blade 231 itself, the urging force is highly uniform and stable. In addition, a force for supporting the blade 231 is generated by its own magnetic force, and hence no special support mechanism is required. The required processing precision associated with the position and shape of the stopper 230 need not be very high. That is, even if the stopper is slightly uneven, the flexible magnetic blade 231 can be positioned in accordance with the uneven shape. Moreover, the urging effect of the blade 231 is hardly influenced and is stable.

Even if the blade 231 is abraded because of long use of it, its functions and effects are not lost. In addition, an attaching/detaching operation for the replacement of blades can be very easily performed. Therefore, the magnetic blade 231 is especially suitable for a case wherein a long developing head is formed.

The roller type developing head of this embodiment has a function of sucking/removing a developing solution from a surface of the sheet-like recording medium 228 in addition to a developing function. In addition, it has a simple arrangement and a small size, and is especially suitable for an apparatus requiring a plurality of developing heads, e.g., a color printer. With the magnetic blade 231, in the roller type developing head of this embodiment, an increase in number of members or in space required for mounting of the blade 231 or the like can be prevented. In addition, difficult processes such as assembly and adjustment of the blade 231 can be omitted. Moreover, in spite of the sealed structure, the blade 231 can be easily attached and detached, and its service life is long.

The developing apparatus shown in FIGS. 11 and 12 is very advantageous in that a developing solution is recovered and removed from the surface of the sheet-like recording medium 228 during a developing operation so as to dry the sheet surface. However, when the suction pump 237 is stopped upon completion of developing, no negative pressure acts. In such a case, in order to remove a developing solution adhering to the surface of the sheet-like recording medium 228, a suction/drying means other than the developing head, or squeeze rollers must be arrange.

Eighth Embodiment

Figure 13:
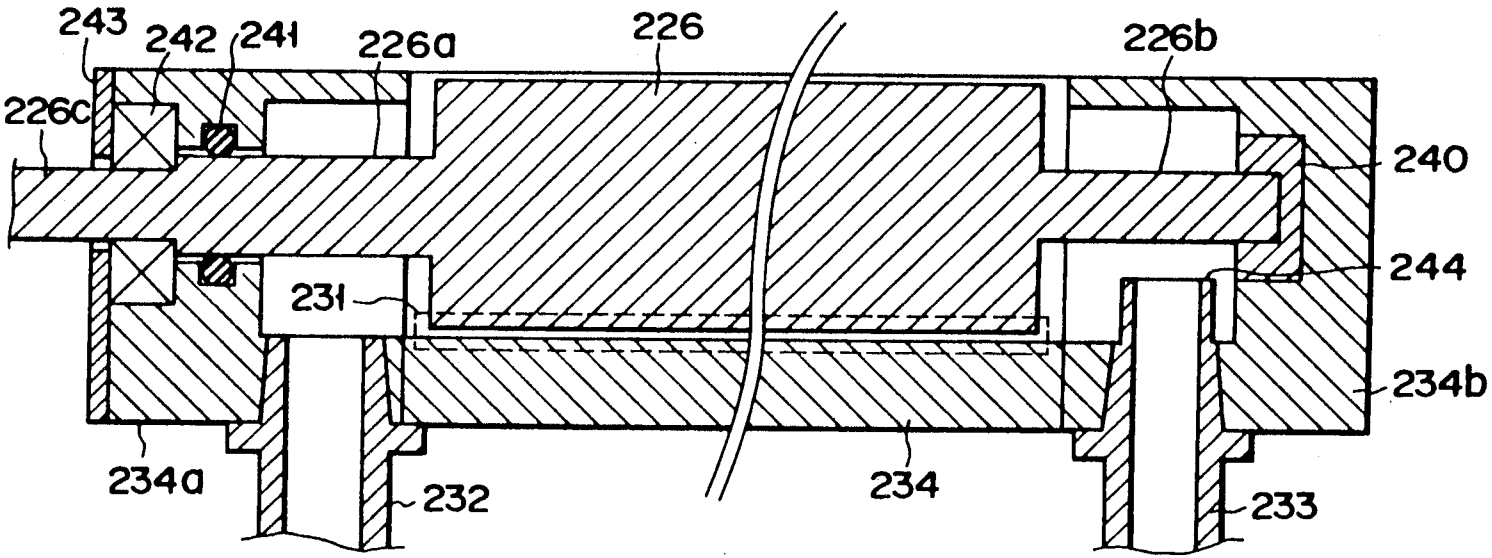
FIGS. 13 and 14 are sectional views showing an arrangement of the eighth embodiment of the present invention.
Figure 14:
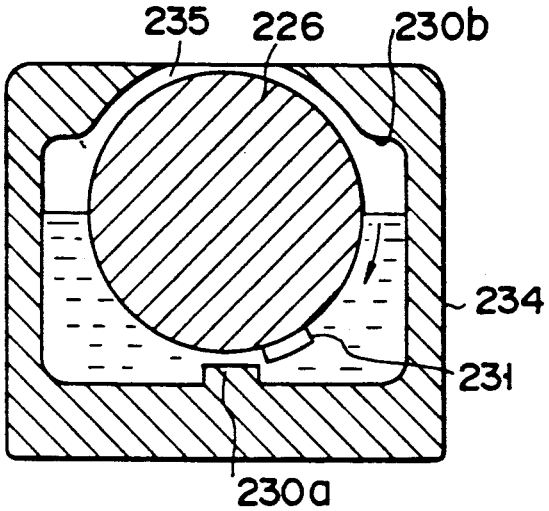

FIGS. 13 and 14 show the eighth embodiment of the present invention, in which a developing solution can be continuously sucked/removed from a surface of a sheet-like recording medium by the effect of a magnetic blade 231 even after a developing operation is completed, thus realizing a developing apparatus requiring no additional suction/drying unit.

Referring to FIGS. 13 and 14, reference numeral 230*a* denotes a first stopper; 230*b*, a second stopper; 226*a* and 226*b*, roller shafts; 226*c*, a driving shaft; 240, a bearing bush; 241, an O-ring; 242, a bearing; 243, a bearing stop; and 244, a developing solution regulating end.

The blade 231 is arranged in advance when a developing head is assembled. A hollow case 234 is designed such that sealing members 234*a* and 234*b* are respectively joined to the two ends of a central member shown in FIG. 14.

Assume that a suction pump is operated to introduce a developing solution into the hollow case 234. When the solution level keeps rising beyond the developing solution regulating end 244 for a while, the amount of air discharged from a discharge port 233 is gradually reduced. Subsequently, the proportion of the developing solution is increased, and the amount of leak air introduced from a developing slit 235 becomes equal to the amount of air discharged from the discharge port 233. At this time, the solution level ceases to rise any more.

When a developing operation is to be performed, a roller 226 is rotated in a direction indicated by an arrow. The functions and effects of the magnetic blade 231 at this time are the same as those described with reference to FIGS. 11 and 12. When the developing roller 226 is rotated in the reverse direction with the suction pump (not shown) being operated upon completion of the developing operation, the magnetic blade 231 is brought into contact with the second stopper 230*b* to be stopped. At this position, the blade 231 slides on the surface of the developing roller 226. If the developing roller 226 is continuously rotated in this state, the developing roller surface reaches a developing portion with the developing solution being removed. As a result, a solution is carried away from a solution pool formed on the developing roller surface.

If a sheet-like recording medium is conveyed after this operation, a developing solution adhering to the sheet-like recording medium surface is sucked/removed because of a negative pressure acting in the developing slit 235. Thereafter, the suction pump is stopped to complete the series of operations associated with developing.

The roller type developing head having the arrangement shown in FIGS. 13 and 14 is very suitable for the above-described operations for the following reason. Since the magnetic blade 231 is magnetically attracted to the developing roller 226, the blade 231 can be moved by rotating the roller 226 in the reverse direction. A stopper position can be set in such a manner that the stop position of the blade 231 is set above the developing solution level.

Referring to FIGS. 13 and 14, since the magnetic blade 231 is positioned between the first and second stoppers 230*a* and 230*b*, the blade 231 must be mounted in advance before the developing head is assembled. In addition, in this arrangement, the magnetic blade 231 cannot be replaced with another one. However, this arrangement can be easily modified into a detachable arrangement.

Ninth Embodiment

Figure 15:
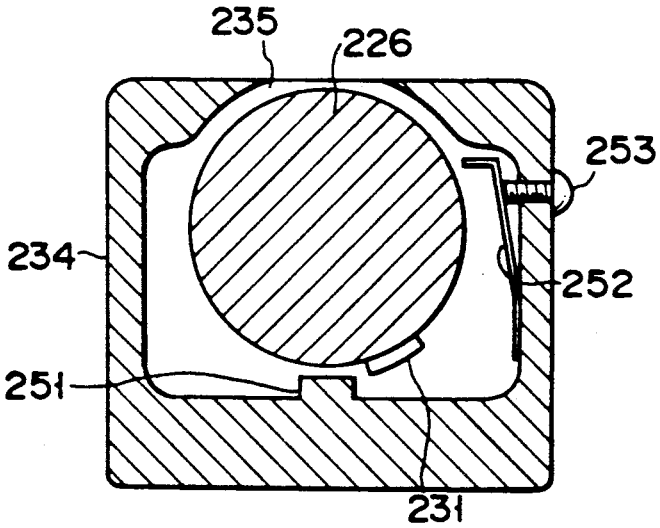
FIG. 15 is a sectional view showing an arrangement of the ninth embodiment of the present invention.

FIG. 15 shows the ninth embodiment of the present invention, which is designed in consideration of the above-described drawbacks. Referring to FIG. 15, reference numeral 251 denotes a stationary first stopper; 252, a movable second stopper; and 253, a second stopper positioning screw. The second stopper 252 is constituted by an elastic metal plate. The lower end portion of the second stopper 252 is fixed to a hollow case 234. The upper end portion of the second stopper 252 is bent toward a developing roller 226. When the positioning screw 253 is unfastened, the second stopper 252 is moved in a direction to be separated from the roller 226, thus obtaining a space in which a magnetic blade 231 can freely pass through the second stopper 252. As a result, the blade 231 can be attached/ detached in a developing slit 235.

If the screw 253 is fastened after the magnetic blade 231 is attached and moved to a position under the second stopper 252, the gap between the second stopper 252 and the roller 226 is narrowed, and the magnetic blade 231 cannot pass through the second stopper 252, thus realizing the same arrangement as shown in FIG. 14.

Tenth Embodiment

Figure 16:
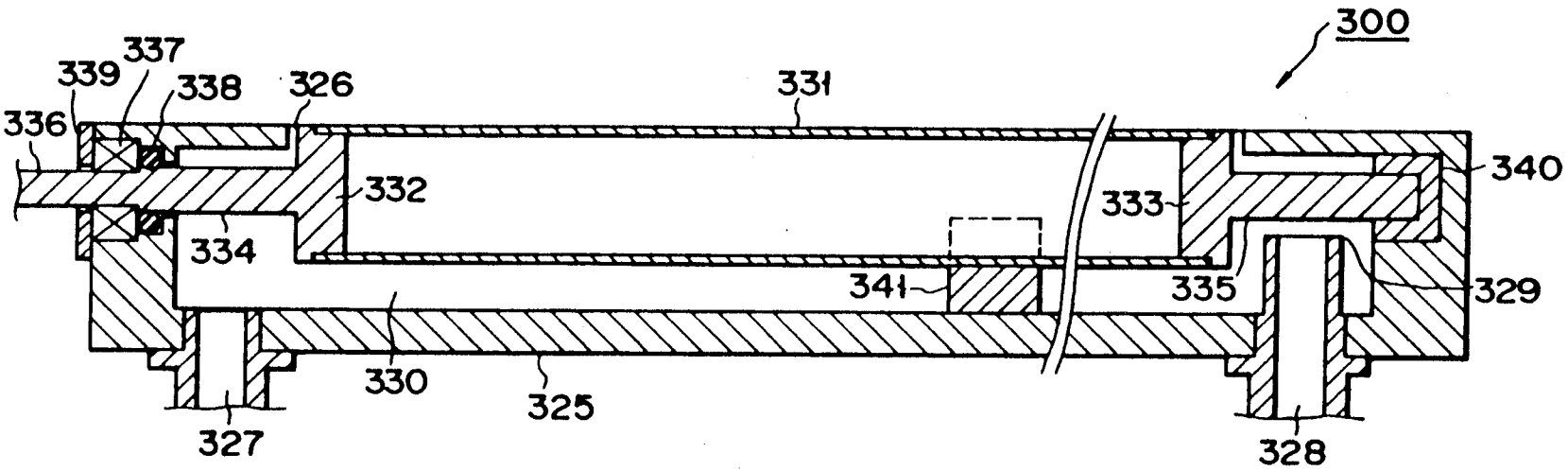
FIGS. 16 and 17 are sectional views showing an arrangement of the tenth embodiment of the present invention.
Figure 17:
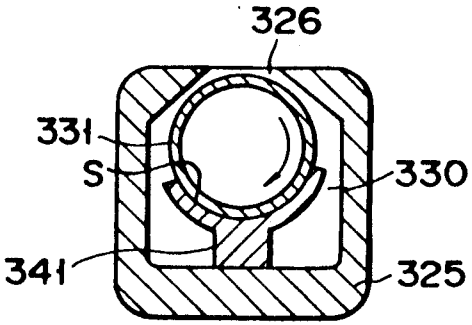

FIGS. 16 and 17 show the tenth embodiment of the present invention. FIG. 16 is a sectional view taken in a direction parallel to the axis of a developing roller of a developing head 300. FIG. 17 is a sectional view taken in a direction perpendicular to the axis of the developing roller.

Referring to FIGS. 16 and 17, reference numeral 325 denotes a case member; 326, a developing slit; 327, a developing solution supply port; 328, a discharge port; 329, a solution level regulating end; 330, a case member inner chamber; 331, a developing roller; 332 and 333, flanges; 334, a driving shaft; 335, a support shaft; 336, a driving shaft end; 337, a bearing; 338, a seal ring; 339, a bearing press member; 340, a bearing bush; and 341, a magnet type roller position regulating member.

A developing solution is introduced from a tank (not shown) into the case member inner chamber 330 through the developing solution supply port 327. The height of the solution level at this time is regulated by the restricting end 329. The developing roller 331 is housed in the case member inner chamber 330. In this embodiment, the developing roller 331 is constituted by a magnetic member.

Since a deviation in rotation of the developing roller 331 is prevented by a magnet, the roller 331 preferably has low rigidity and high flexibility. In this case, the developing roller 331 is constituted by a metal pipe. The flanges 332 and 333 are respectively fitted in the two ends of the pipe. The shafts 334 and 335 are respectively provided to the flanges 332 and 333. One shaft 334 is axially supported on one side wall of the case member 325 by the bearing 337, and the driving shaft end 336 extends outside the case member 325. The seal ring 338 is arranged for sealing. The press member 339 prevents the bearing 337 from being removed. The other shaft 335 is axially supported on the other side wall of the case member 325 by the bearing bush 340 embedded therein. The magnet type position regulating member 341 is mounted on the bottom of the case member 325. The upper surface of the position regulating member 341 is formed into an arcuated roller position regulating surface S for receiving the outer surface of the developing roller 331. The magnet type position regulating member 341 is preferably set at a position where the developing roller 33 is most likely to bend, e.g., the middle position in the longitudinal direction of the developing roller 331. Such regulating members may be arranged at a plurality of positions to obtain a satisfactory effect as needed.

The shafts 334 and 335 and the like can be processed by shaft formation processing to be concentrical with the metal pipe roller 331 after the flanges 332 and 333 are attached to the roller 331. If, however, the roller 331 has a small diameter and a large length, it is normally difficult to maintain its linear shape by itself, and the roller 331 is bent in the form of an arc. The position regulating member 341 is incorporated such that its roller position regulating surface S is set at the designed outer surface position of the developing roller 331 in a state wherein the developing head is assembled. When the bent surface of the arcuated roller 331 comes to the lower position, it is urged against the regulating surface S to be fixed at the designed outer surface position. When the bent surface of the arcuated roller 331 comes to the upper position, it is attracted to the position regulating surface S by the attracting force of the magnet type position regulating member 341 so as to be positioned to the designed outer surface position. The roller 331 is magnetically attracted to the regulating surface S. However, since the roller 331 is rotated in a direction to slide the magnetically attracted surface, the rotational load is not increased much even if the attracting force is increased.

The straightens of the developing roller 331 during rotation is determined by the position regulating surface S of the magnet type position regulating member 341, and only a deviation from the roundness of the roller 331 during rotation is present. Therefore, even if a flexible, small-diameter, and long roller is employed, rotational surface position precision required for developing can be stably ensured.

The overall magnet type position regulating member 341 may be constituted by a magnet. However, it is not necessary.

Eleventh Embodiment

FIGS. 18 to 21 show the eleventh embodiment of the present invention, specifically various modifications of the roller position regulating member 341.

Figure 18:
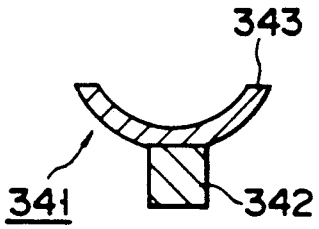
FIGS. 18 to 21 are views showing the eleventh embodiment of the present invention obtained by partly modifying the tenth embodiment.

FIG. 18 shows a case wherein a roller position regulating member 341 is constituted by a magnet body 342 and a position regulating member 343 consisting of a magnetic member. The magnet body 342 is preferably made of sintered ferrite or the like. Since ferrite has high hardness, a curved surface is formed by molding. In addition, since a developing roller surface tends to be damaged, the position regulating member 343 is made of a magnetic metal which is easy to process and has hardness lower than that of ferrite.

Figure 19:
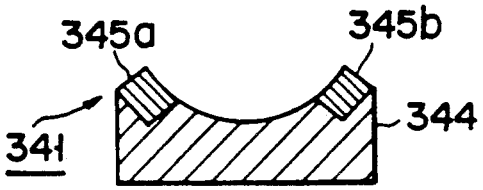

FIG. 19 shows an embodiment in which a pair of magnets 345*a* and 345*b* are respectively arranged and held on the two ends of a position regulating member 344. In this case, the position regulating member 344 need not be constituted by a magnetic member but is preferably constituted by a nonmagnetic member, such as a plastic member or an aluminum alloy, which is easy to process and does not damage the roller surface. If surfaces of the magnets 345*a* and 345*b* are slightly receded from the position regulating surface, or the magnet surfaces are covered with protective films as will be described later, a magnet having high hardness, such as ferrite, can be used without posing any problem.

Figure 20:
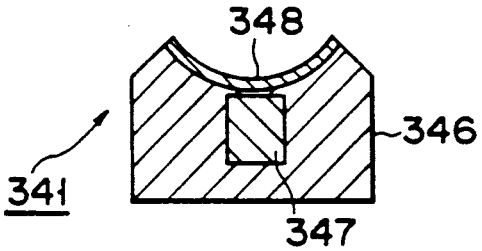

FIG. 20 shows an embodiment wherein a position regulating surface is lined with a material 348 having a low friction coefficient so as to reduce the rotational load of a developing roller 331 (shown FIG. 16) while maintaining the attracting force of a magnet. Reference numeral 346 denotes a support member; 347, and a magnet; 348, a lining member. A material for the support member 346 is not limited to a plastic material, a metal, or the like. The material may be magnetic or nonmagnetic. Various types of plastic materials used as bearing materials are preferably used for the lining number 348.

Figure 21:
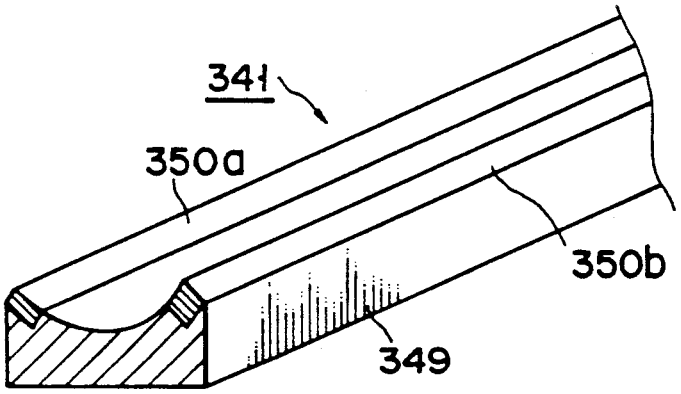

The respective embodiments described above are associated with modifications of the cross-sectional shape of the roller position regulating member 341. FIG. 21 shows an embodiment wherein a roller position regulating member 341 is longitudinally extended along the roller axis.

Referring to FIG. 21, reference numeral 349 denotes a support member; and 350*a* and 350*b*, magnets, respectively. In this case, a surface of the support member 349 may serve as a roller position regulating surface. Alternatively, the surfaces of the magnets 350*a* and 350*b* may serve as position regulating surfaces. The support member 349 may consist of any of a plastic material, a metal material, a magnetic material, and a nonmagnetic material. A roller position regulating member 341 and a developing roller have the same length.

If the magnets 350*a* and 350*b* themselves serve as roller position regulating surfaces, their lengths are set to be equal to the length of the developing roller 331. Each of the magnets 350*a* and 350*b* is preferably constituted by a strip-like magnet obtained by dispersing ferrite particles in a binder such as a rubber or plastic material and magnetizing them.

The roller position regulating member 341 having such an arrangement slides on the entire surface of the developing roller 331 in the longitudinal direction when the roller 331 is rotated. As a result, a solution layer adhering to the developing roller surface and having a toner density decreased upon developing is forcibly removed. A new developing solution having a predetermined toner density is supplied to the developing roller surface upon removal of the solution layer. Therefore, the developing performance is improved, and a developing solution having a high toner density on a portion of the developing roller which corresponds to a non-imaging portion is removed. This provides various effects, e.g., preventing a fog in the non-imaging portion.

In this case, therefore, the position where the developing roller 331 escapes from the roller position regulating surfaces S must be set to be lower than a developing solution surface. This equally applies to the embodiments shown in FIGS. 16 to 20.

Twelfth, Embodiment

Figure 22:
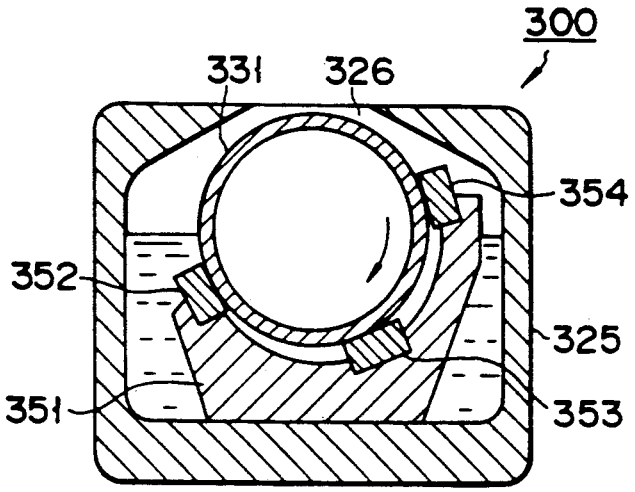
FIGS. 22 and 23 are views showing the twelfth embodiment of the present invention.
Figure 23:
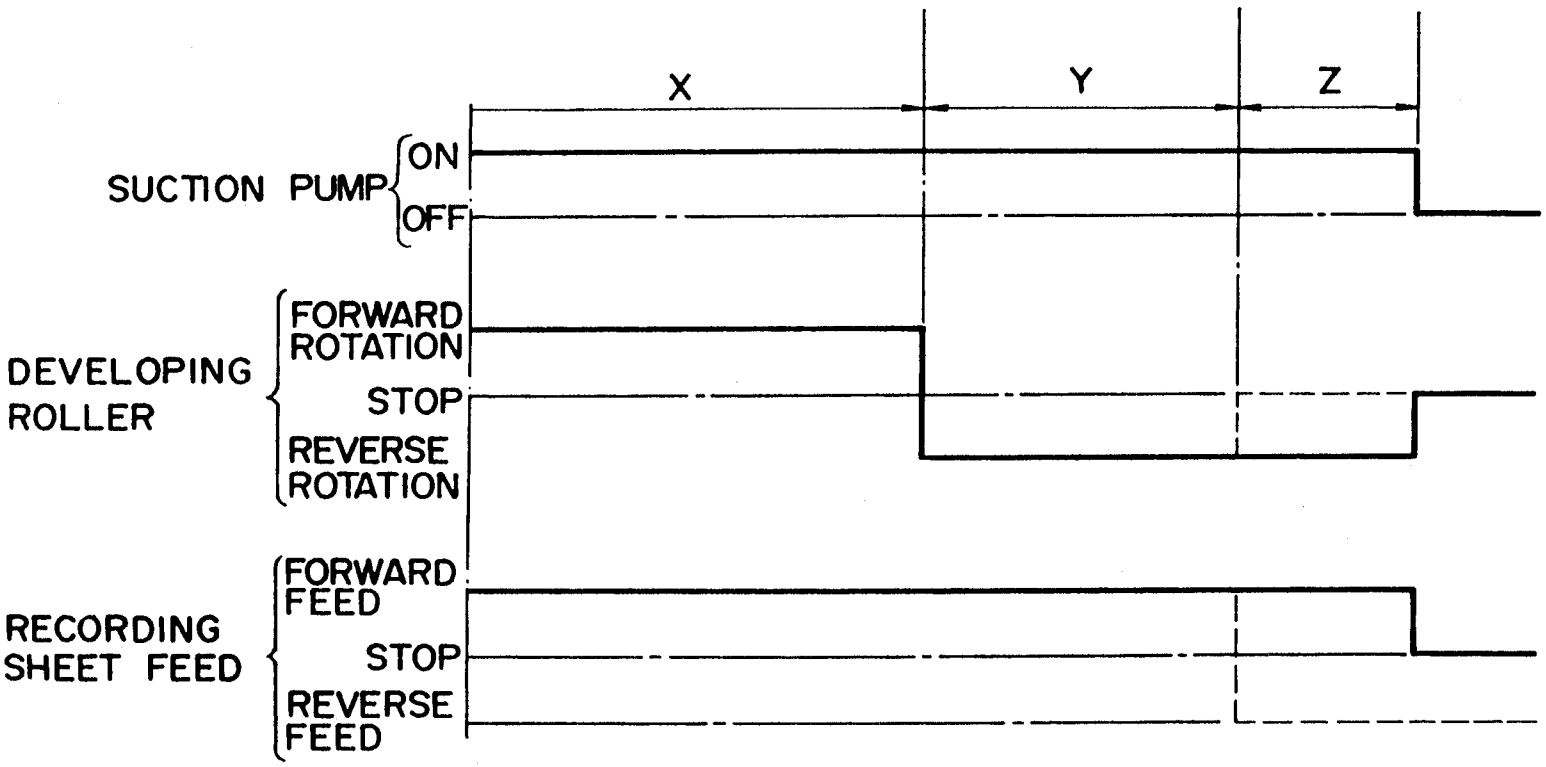

FIGS. 22 and 23 show the twelfth embodiment of the present invention. Referring to FIG. 22, reference numeral 351 denotes a support member; and 352, 353, and 354, magnets, respectively. Note that a developing solution supply port, a discharge port, and the like have arrangements similar to these described with reference to FIG. 16.

In this embodiment, the magnets 352, 353, and 354 also serve as developing roller position regulating surfaces. Each magnet has the same length as that of a developing roller 331. If the magnets 352, 353, and 354 have flexibility similar to that of a rubber magnet, the support member 351 is set to have the same length as that of the developing roller 331 so as to stably support the respective the magnets 352, 353 and 354. At least one of the roller position regulating surfaces is located above a solution level, and another surface is located under the solution level. Referring to FIG. 22, the magnets 352 and 353 are located under the solution level, and the magnet 354 is located above the solution level. The magnet 354 on the upstream side in the rotating direction of the developing roller 331 during a developing operation is located above the solution level, whereas the magnet 352 on the downstream side is located under the solution level. A roller position regulating surface other than the above surfaces is to be arranged therebetween, as indicated by reference numeral 353.

During a developing operation, the developing roller 331 is rotated in a direction indicated by an arrow. A developing solution adhering to the developing roller 331 serves to develop at a developing portion in the middle of a developing slit 326. Upon developing, the developing solution is forcibly removed by the magnet 354 constituting the upstream position regulating surface. When the roller surface escapes from the magnet 352 constituting the downstream position regulating surface, a surrounding developing solution adheres to the roller surface and is carried to the developing portion. In this manner, a developing solution having no toner consumed and having a predetermined toner density is sequentially carried to the developing portion, thus maintaining high-performance developing. In addition, since a negative pressure always acts on an opening portion of the developing slit 326 during a developing operation, a developing solution is removed from a surface of a sheet-like recording medium which passes through above the opening portion.

The developing head shown in FIG. 22 is characterized in that it can be operated to remove a developing solution adhering to a surface of a sheet-like recording medium after a developing operation. An operation of the developing head will be described below with reference to a timing chart in FIG. 23.

Referring to FIG. 23, the axis of abscissa indicates an elapsed time. Reference symbol X denotes the developing step; Y, the step of removing a solution pool formed on the developing portion upon developing; and Z, the step of sucking/drying a developing solution on a surface of a sheet-like recording medium.

As shown in FIG. 23, a suction pump is operated in the developing step X, and the developing roller 331 is rotated in the direction indicated by the arrow, i.e., in the forward direction. Meanwhile, a sheet-like recording medium is also conveyed in the forward direction. Even after developing is completed, the suction pump is continuously operated to maintain the opening portion of the developing slit at a negative pressure.

If the developing roller 331 is rotated in the direction opposite to the direction indicated by the arrow, the developing solution is removed from the roller surface which has escaped from the developing solution surface by the effect of the magnet 354, thus removing the developing solution from the developing portion by the effect of the roller surface. During this period, the sheet-like recording medium may be stopped. If, however, the medium is continuously conveyed, the developing solution in the solution pool is also carried by the medium.

Even if the solution pool is removed, the surface of the sheet-like recording medium is still wet with the developing solution. Therefore, it must be dried after all.

Reference symbol Z denotes the step of sucking/drying the adhering developing solution. In the sucking/drying step, the suction pump is continuously operated to maintain the opening portion at a negative pressure. The developing roller 331 may be continuously rotated in the reverse direction, or may be stopped. When the sheet-like recording medium is conveyed, and the wet portion passes through above the opening portion of the developing slit, the sheet-like recording medium is dried. This embodiment can be suitably applied to a recording apparatus designed to overlap images of different colors by reciprocating a sheet-like recording medium, such as a multipath color printer, for the following reasons. By moving a sheet-like recording medium in the rewind direction, a portion, of the sheet-like recording medium, to be wastefully consumed can be reduced, and the time required for a rewind operation can be shortened.

In the embodiment shown in FIG. 22, the magnets also serve as the developing roller position regulating member. However, roller position regulating member may be arranged independently of the magnets. In addition, it is apparent from the above description that a magnet or an independent position regulating member which requires the same length as that of the developing roller 331 is the magnet 354, and shorter magnets may be discretely arranged as other magnets.

Thirteenth Embodiment

Figure 24:
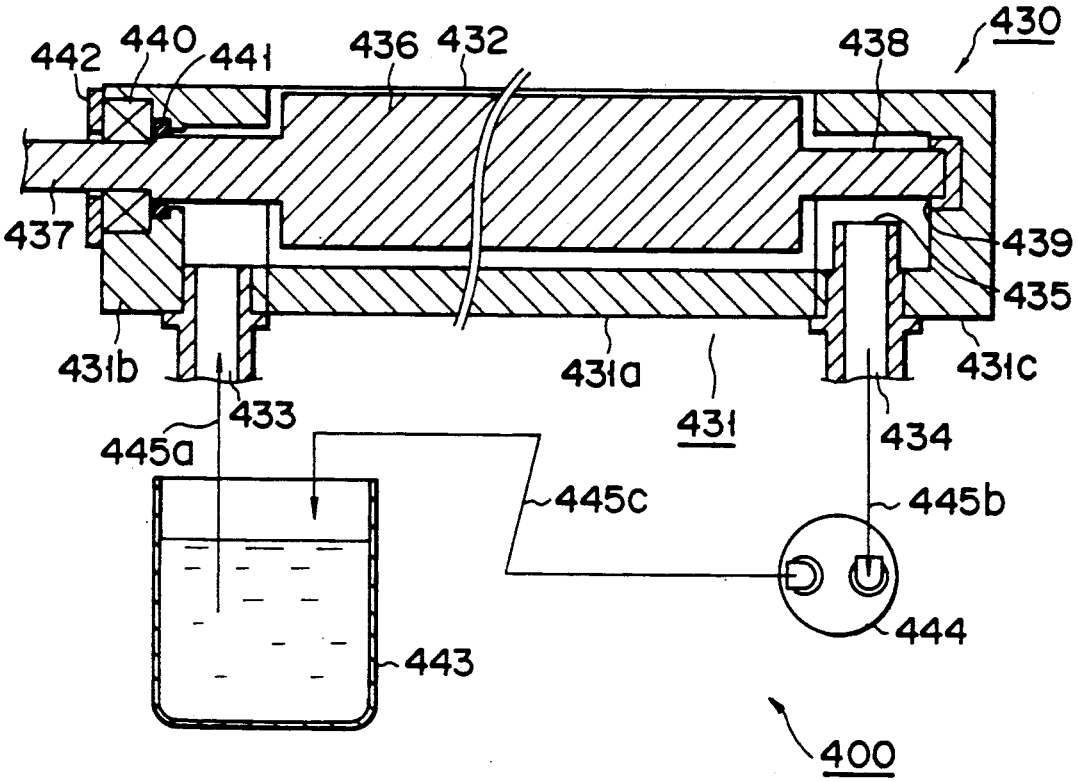

FIGS. 24 to 28 show the thirteenth embodiment. Referring to FIG. 24, reference numeral 431 (431*a*, 431*b*, and 431*c*) denotes a hollow case; 432, a developing slit 433, a developing solution supply port; 434, a discharge port; 435, a liquid level regulating end; 436, a developing roller; 437, a driving side roller shaft; 438, a support side roller shaft; 439, a bearing bush; 440, a bearing; 441, a seal ring; 442, a bearing press member; 443, a developing solution tank; 444, a suction pump; and 445*a*, 445*b*, and 445*c*, pipes.

Figure 25:
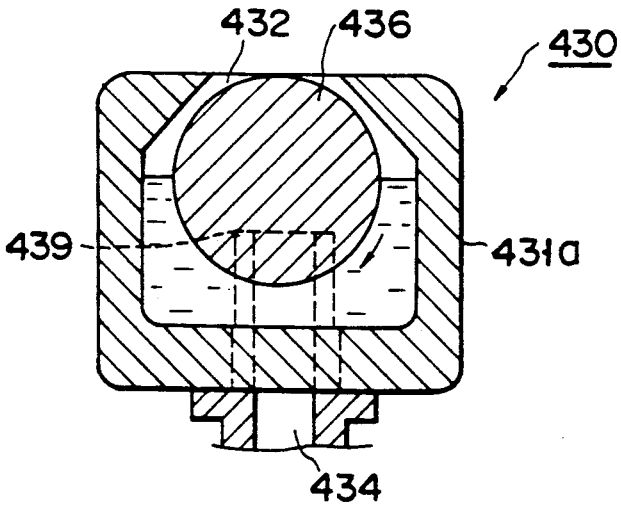

The hollow case 431 is formed by joining end sealing members 431*b* and 431*c* to the two ends of a hollow member 431*a* whose cross-section is shown in FIG. 25. The developing solution supply port 433 is arranged at one end of the hollow case 431, and the discharge port 434 is arranged at the other end of the case 431. Although the developing slit 432 is formed in the upper surface of the hollow case 431, other portions are sealed. A spiral groove is formed in the outer surface of the developing roller 436 (to be described in detail later). The sectional shape of the spiral groove is designed such that the length of a sheet-like recording medium portion in a direction parallel to the roller axis is ½ or more a groove pitch in the axial direction of the developing roller within a range in which the distance between the inner wall of the groove and the sheet-like recording medium surface is 2 mm or less. In addition, the lead angle of the spiral groove is set to be 30° or less. When the spiral groove passes through a plane perpendicular to the longitudinal axis of the roller at a point T, it forms an angle between the spiral groove and the plane perpnedicular to the longitudinal axis. If a tangent is then drawn to point T, on this spiral groove, then the angle between the tangent and the perpendicular plane at point T is the "lead angle". One shaft 438 of the developing roller 436 is axially supported by the bearing bush 439. The other driving shaft 437 is axially supported by the bearing 440. The seal ring 441 is used to hold airtightness.

The developing solution tank 443 is connected to the developing solution supply port 433 through the pipe 445*a*. The discharge port 434 is connected to the suction pump 444 through the pipe 445*b*. The suction pump 444 is connected to the developing solution tank 443 through the pipe 445*c*.

The developing slit 432 is covered with a sheet-like recording medium having a width slightly larger than the length of the developing slit 432 while the electrostatic latent image formation surface of the medium faces down. If the suction pump 444 is operated in this state, the sheet-like recording medium comes into tight contact with a peripheral surface of the developing slit 432 and seals the slit 432 by the effect of air flowing into the slit 432.

When the air in the hollow case 431 is further removed to increase the negative pressure, the developing solution flows from the developing solution tank 443 into the hollow case through the pipe 445*a* and the developing solution supply port 433.

When the developing solution level is raised above the liquid level regulating end 435, both the developing solution and the air are discharged from the discharge port 434. The solution level stops rising when the amount of air leaking through a small gap between the peripheral surface of the slit 432 and the sheet-like recording medium becomes equal to the amount of discharged air, and the developing solution is set in a stable circulatory state.

The sheet-like recording medium is deflected inward by a force generated by the negative force acting in the developing slit 432. The recording medium is then conveyed while it is supported on a top portion of the spiral groove of the developing roller 436. That is, the gap and the movement of the developing solution required for developing are ensured by the effect of the groove formed in the developing roller 436. Therefore, as long as high sectional surface processing precision of the groove is maintained, stable, high-performance developing performance can be obtained even if the precision of other elements is not very high.

Figure 26A:
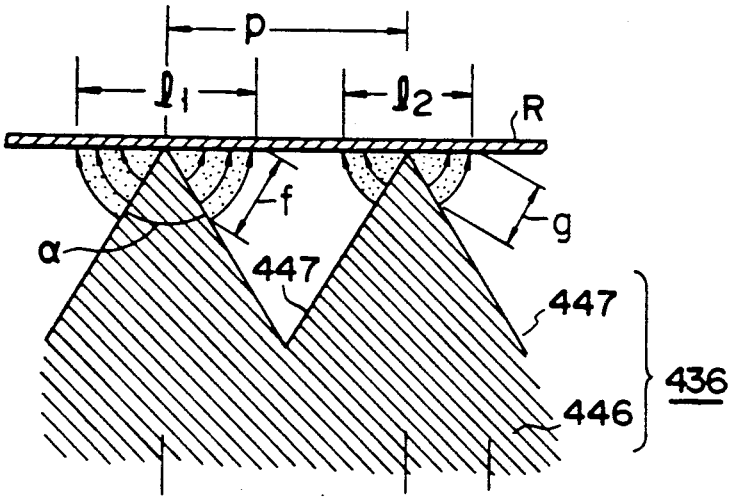

A spiral groove applied to the developing roller 436 will be described in detail with reference to FIGS. 26A–C. Referring to FIG. 26A, reference numeral 436 denotes a developing roller; 446, a roller base; and 447, a spiral groove. Reference symbol p denotes a groove pitch; l1, a high-image density region obtained when a high-potential latent image is developed; l2, a high-image density region obtained when a low-potential latent image is developed; x in FIG. 26B, an image density distribution curve near l1; y in FIG. 26*c*, an image density distribution curve near l2; and D, an image density in FIGS. 26B and 26C.

FIG. 26A shows a state wherein a sheet-like recording medium is substantially supported on top portions of a spiral groove 447, in which a lateral direction corresponds to the axial direction of the developing roller 436. Assume that electrostatic latent image charges formed on the sheet-like recording medium R are uniformly spread. Owing to the presence of the latent image charges, lines of electric force indicated by arrows are generated between the inner wall of the spiral groove 447 as a conductive groove and a surface of the sheet-like recording medium R. Charged toner particles in the developing solution are subjected to electrophoresis along the lines of electric force. An electrophoretic force is generated in proportion to the strength of a potential gradient along the lines of electric force, and electrophoresis occurs against the viscous resistance of a developing solution solvent. Therefore, in a region having a strong potential gradient near a top portion of a spiral groove 447, toner particles are moved at high speed to contribute to developing. However, as the distance between a side wall of a spiral groove 447 and a sheet-like recording medium R is increased, developing becomes difficult.

According to an experimental result (to be described later), it was found that when developing was to be performed while a sheet-like recording medium R was moved at a speed of several ten mm, a high electrophoretic speed required for developing was obtained when the gap between the sheet-like recording medium R and the outer surface of the roller 436 serving as an electrode was 0.2 mm or less. It was also found that as the gap was increased to 0.2 mm or more, a required electrophoretic speed could not be obtained, thus causing a decrease in developed image density.

In addition, it was found from an experiment on a roller with a groove that when a low-potential latent image was developed, the gap required for high-speed developing was further reduced to about 0.13 mm represented by "g" in FIG. 26A. Referring to FIG. 26A, in a region indicated by arc-like arrows near the left top portion of the spiral groove 447, high=speed electrophoresis occurs with respect to a latent image having a potential of about 100 V. In a strict sense, an electric gradient is changed in accordance with the arc length of each line of electric force. However, when the arc angle of each line of electric force is 60° or less, no significant deviation of an electric gradient is caused even if the rectilinear distance "F" in FIG. 26A between the inner wall of the groove and the sheet-like recording medium R is substituted for the arc length. Reference symbol l1 denotes the length of the sheet-like recording medium R region in a direction parallel to the roller axis in a range in which the distance between the inner wall of the groove 44,7 and the sheet-like recording medium R is 0.2 mm or less. In this region, a high-density image can be obtained.

Referring to FIG. 2B, reference symbol x denotes an image density distribution curve in a region including the high-density region corresponding to the width l1. In a solid image, since an adjacent top portion of the groove is present at a distance p, and a high-density region is formed therein, even if a region having a relatively low density is present between high-density portions, developing streaks are hardly noticeable.

If the inclination angle of a locus drawn by a high-density region is increased, the high-density region is slightly increased in width, and developing streaks become less noticeable.

In consideration of such a situation, if the sheet-like recording medium R region width l1 in the axial direction of the roller is set to be not less than ½ the groove pitch p in the axial direction of the roller within the range in which the gap between the inner wall of the spiral groove 447 and the sheet-like recording medium R is 0.2 mm or less, a developed image having no noticeable developing streaks can be obtained. If the groove pitch is 0.6 mm, and an angle α of a top portion of the groove is 60°, the width l1 becomes about 4.5 mm, thus satisfying preferable conditions.

Figure 26B:
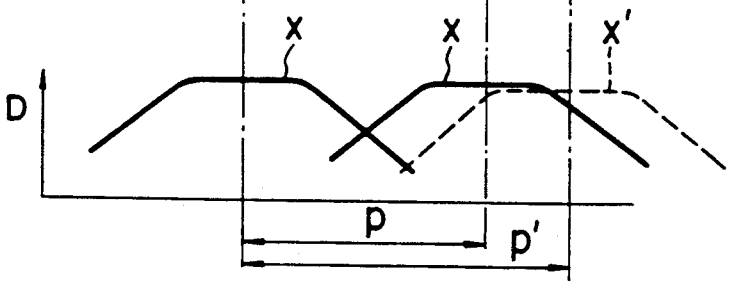
Figure 26C:
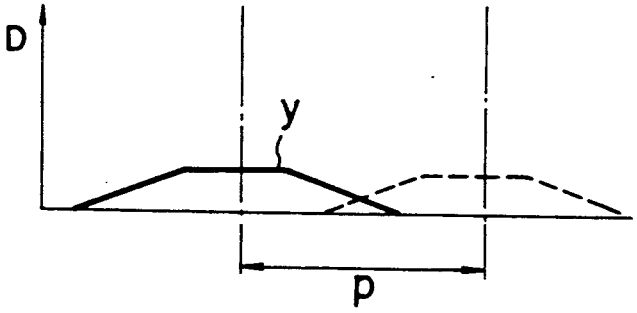

Referring to FIG. 26B, reference symbol x' denotes a high-density region obtained when the groove pitch of a groove having the same angle at the top portion as that described above is set to be 0.8 mm. It is apparent that if the groove pitch is further increased, a region having a considerably low density is formed between high-density portions.

With a groove having a vertex angle of 60° and indicated by l2 in FIG. 26A a high-density region obtained when the potential of an electrostatic latent image is as low as about 10 to 20 V corresponds to a region having a length of about 0.3 mm. FIG. 26C is a graph showing the density distributions of adjacent regions. In order to prevent a high-density portion from becoming noticeable as developing streaks, the width l1 is preferably set to be ½ or more than the groove pitch. With respect to a groove having a vertex angle of 60°, the groove pitch is preferably set to be 0.6 mm or less.

Figure 27:
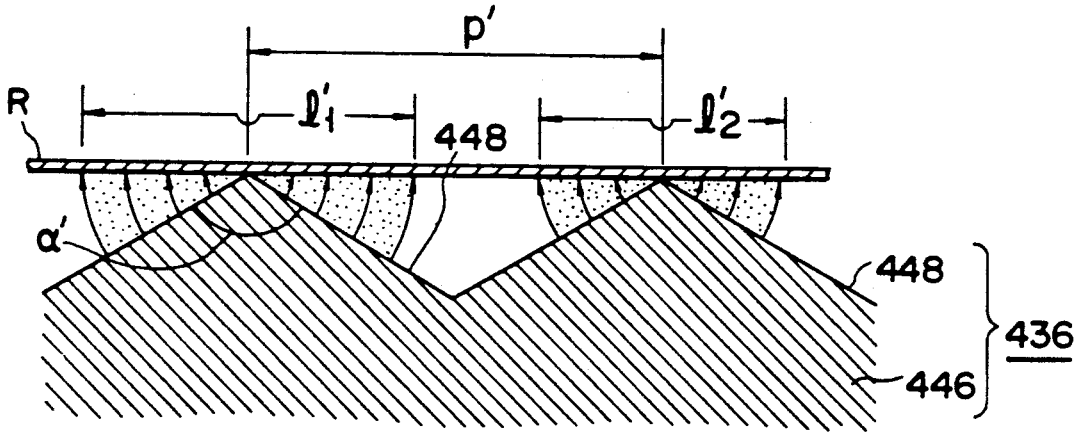

FIG. 27 shows another groove arrangement for achieving the above conditions without forming a groove at a small pitch. Referring to FIG. 27, reference numeral 436 denotes a developing roller; 446, a roller base; 448, a spiral groove; p', a groove pitch; l1', a high-image density region of a high-potential latent image; and l2', a high-image density region of a low-potential latent image. In the embodiment shown in FIG. 27, even if an apex angle α and a groove pitch p are increased, the high-image density regions l1' and l2' can be increased in width. In addition, arc-like arrows indicate lines of electric force in regions in which high-speed electrophoresis occurs.

If the groove pitch is 1 mm, and the apex angle α' of the groove is 120°, the widths l1' and l2' become 0.8 and 0.6 mm, respectively, thus satisfying the above-mentioned preferable conditions.

Note that the groove need not have a triangular sectional shape. For example, it may have a trapezoidal sectional shape so as to increase each high-density region.

Figure 28:
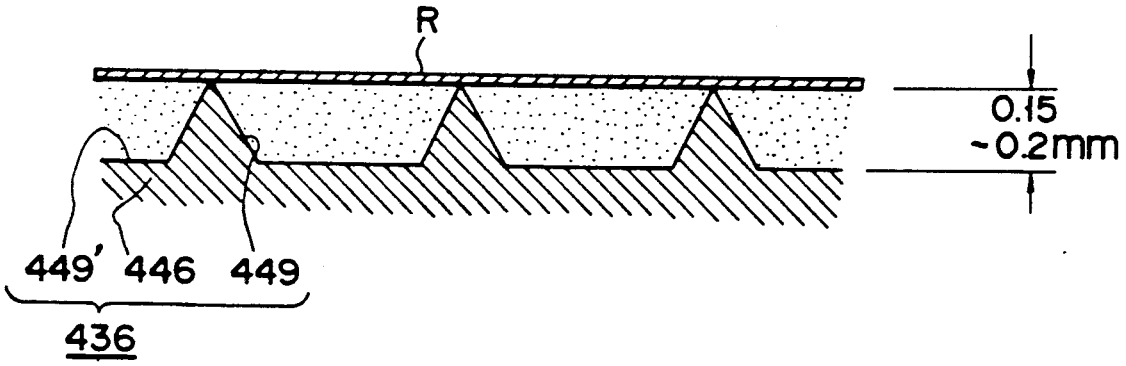

FIG. 28 shows a modification in which a groove having such a different cross-section is applied. Referring to FIG. 28, reference numeral 436 denotes a developing roller; 446, a roller base; and 449, a spiral groove. The groove 449 comprises ascending portions for defining a space for supporting a sheet-like recording medium R and holding/transferring a developing solution, and a flat bottom surface 449' serving as a developing electrode. If the height of each ascending portion is set to be 0.15 to 0.2 mm, since the conditions of a high-density region are satisfied throughout the sheet-like recording medium R, density nonuniformity can be eliminated, and developing is performed with high efficiency.

In the above-described thirteenth embodiments, the developing performance greatly varies in accordance with the gap between a roller surface serving as a developing electrode and a sheet-like recording medium R. Experiments conducted to confirm this will be described with reference to FIGS. 29 and 30.

Figure 29:
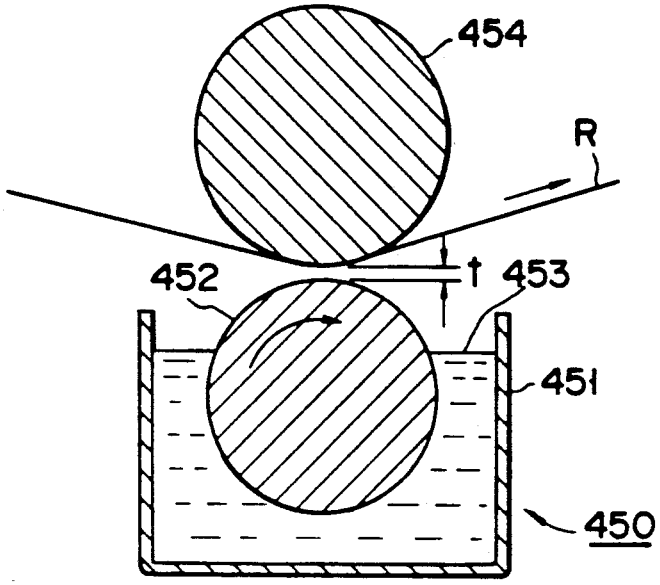
FIGS. 29 and 30 are views showing an experimental result according to the thirteenth embodiment.

FIG. 29 shows an arrangement of an apparatus used for the experiments. Reference numeral 450 denotes a developing head; 451, a developing solution tray; 452, a developing roller having a smooth surface; 453, a developing solution; and 454, a backup roller.

The developing roller 452 was rotated by a variable speed motor (not shown) at rotational speeds between 400 to 1,400 rpm. A sheet-like recording medium R was uniformly charged to apply uniform charges of 100 V on its surface by using a corona charger (not shown) before it reached the developing head 450. The medium was then conveyed at a speed of 38 mm/sec.

The gap t between the outer surface of the developing roller 452 and the sheet-like recording medium R was set to be variable, and experiments were conducted while the gap was adjusted to values between 0.1 mm to 0.5 mm.

As a developing solution, a black toner developing solution for a color electrostatic plotter EP4000 available from Seiko Electronic Industry Corporation was used. As a solvent, IRIFAR G (trade name: Exon Corporation) was used.

Figure 30:
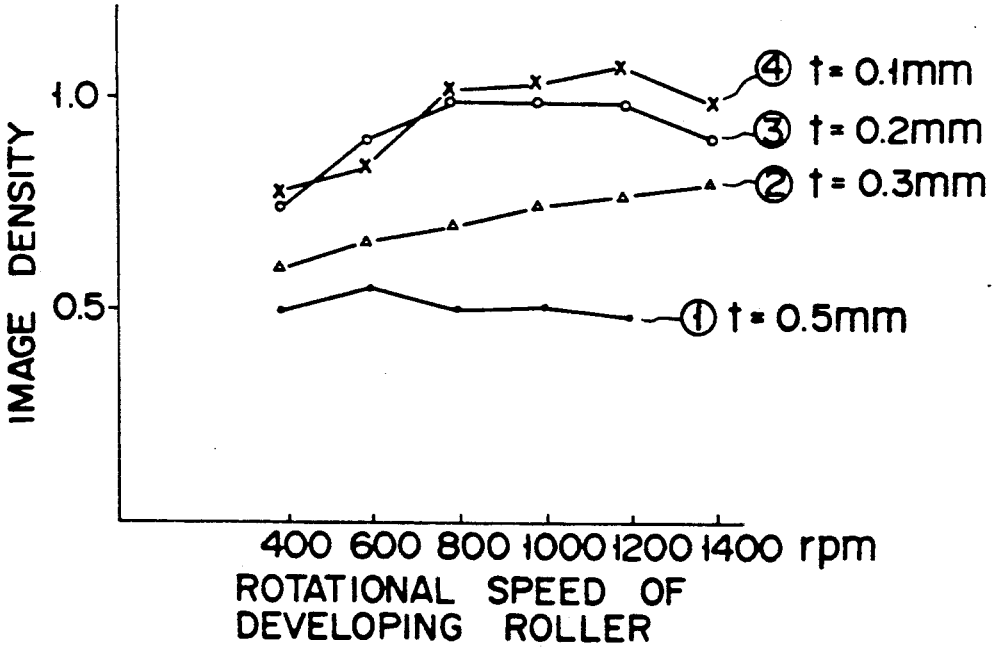

FIG. 30 is a graph summarizing experimental results, in which the developed image density is plotted along the axis of ordinate, and the rotational speed of the developing roller is plotted along the axis of abscissa. Referring to FIG. 30, curves 1 to 4 represent results obtained when a developing gap t is changed from 0.5 to 0.1 mm.

According to the above results, it is understood that when the developing gap is set to be 0.1 to 0.2 mm, there are small differences between image densities obtained, high densities can be obtained, and electrophoresis occurs at high speed. In contrast to this, as the gap t is increased to 0.3 and 0.5 mm, the developed image density is decreased. This indicates that the potential gradient is not sufficient to cause electrophoresis required for developing. It is understood from such experimental results and the like that in order to obtain a developed image having a high density, a developing gap of 0.2 mm or less must be maintained. That is, in the developing roller with a spiral groove, with the above-described basic arrangement, a good result can be obtained.

In this embodiment, in order to maintain a small gap, it is preferable that a sheet-like recording medium R is arranged close to the top portions of the spiral groove and is conveyed so as to be substantially supported thereby. In this regard, the arrangement shown in FIG. 24 is preferable because the negative pressure acting on the developing slit acts to urge the sheet-like recording medium R against the roller surface. In an apparatus having no negative pressure effect, it is preferable that guide rollers, guide plates, and the like are arranged to cause the travel position of a sheet-like recording medium R to move on a level equal to or slightly lower than that of the uppermost surface of a developing roller at positions before and after the roller, thus causing a surface of the medium R to sufficiently approach roller top portions and causing the roller top portions to support the medium R.

Fourteenth Embodiment

Figure 31:
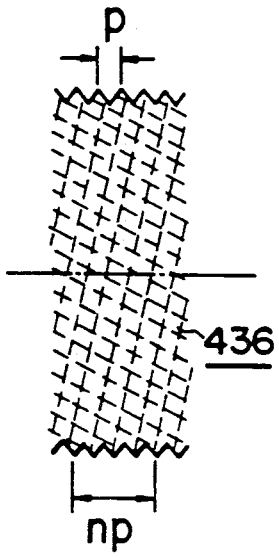
FIGS. 31, 32, and 33 are views showing the fourteenth embodiment of the present invention.
Figure 32:
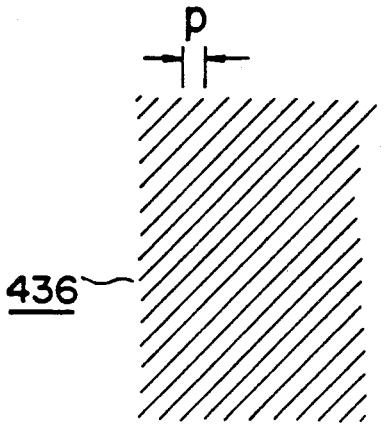
Figure 33:
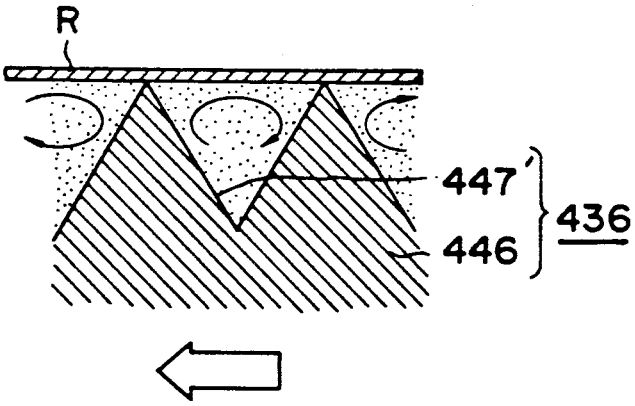

FIGS. 31 to 33 show the fourteenth embodiment. In this embodiment, a spiral groove is formed into a multiple thread groove to increase the lead angle in order to reliably prevent developing streaks by improving the developing efficiency by using the developing roller having the groove sectional shape defined in the above-described manner.

Referring to FIG. 31, reference numeral 436 denotes a developing roller. The spiral groove having the sectional shape described with reference to FIG. 26 is formed in the outer surface of the developing roller 436. In the roller 436 shown in FIGS. 31 and 32, the pitch of adjacent grooves is p, and each groove is constituted by n thread grooves ($n \geqq 2$). Therefore, the pitch of a single groove is np, and the lead angle of the groove is substantially n times that of a single thread groove.

The number n of thread grooves is not specifically limited. If, however, the lead angle of a groove exceeds 45°, various inconveniences are caused. In order to prevent such inconveniences, the lead angle is set to be 30° or less, and several or several tens thread grooves are preferably formed per groove. For example, in a developing roller having a diameter of 25 mm, if the pitch of adjacent grooves is 0.6 mm, and 10 thread grooves are formed per groove, the lead angle of each groove is about 14°.

If the lead angle is increased by forming multiple thread grooves, the inclination angle of a locus drawn on a sheet-like recording medium R by a top portion of each groove is increased, as shown in FIG. 32. With this increase, the width of a high-density region is slightly increased.

Another effect obtained when the lead angle of each groove is increased is that a developing solution is periodically and forcibly removed from a sheet-like recording medium surface, and another developing solution is supplied, thus improving the developing efficiency.

FIG. 33 is a view for explaining this effect. Referring to FIG. 33, assume that multiple thread spiral grooves 447' are formed in the developing roller 436.

With regard to a single thread roller, when the roller is rotated, the roller surface is moved at high speed in the circumferential direction. A developing solution viscously adhering to a surface of a sheet-like recording medium R has a toner consumed upon developing but is not easily replaced with another developing solution portion due to the viscous adhesive force. A developing solution viscously adhering to the inner wall of each developing roller groove is moved at high speed together with the developing roller surface. Therefore, a solution in an intermediate region between the above regions is moved at intermediate speed. However, when the developing roller 436 is rotated once, the top portions of each groove are moved by one pitch in the axial direction of the developing roller 436. Since the top portions of each groove slide on the sheet-like recording medium surface upon this movement, even if a single thread groove is employed, a developing solution on the sheet-like recording medium surface is completely replaced with another solution portion once per revolution of the developing roller.

In order to efficiently perform developing, the electrophoretic force must be increased, and a fresh developing solution must be supplied upon removal of a developing solution having a decreased toner density from a sheet-like recording medium surface. If the n-thread groove arrangement is employed, a developing solution on a sheet-like recording medium surface is replaced with another solution portion n times per revolution of the developing roller 436. This effect greatly contributes to the promotion of a developing operation. At the same time, flows of a developing solution are generated in directions indicated by arrows in FIG. 33, and a developing solution held in each groove is slightly agitated. Such an effect contributes to an improvement in developing efficiency. With an increase in lead angle of each groove, the above-described effect is enhanced. If, however, the lead angle becomes 45° or more, various problems are posed. Therefore, multiple thread grooves are preferably formed such that the lead angle is set to be 30° or less as described above, or 15° or less in consideration of easy processing.

In the apparatus of the present invention, the arrangement of the spiral groove improves the developing performance and enables high-speed developing while maintaining the following characteristic features: easily removing a developing solution from the groove upon completion of a developing operation; requiring a small amount of toner to be dried and hardened; facilitating processing of the groove; and preventing developing streaks by efficiently replacing a developing solution held in the groove during a developing operation. However, in order to more efficiently replacing a developing solution held in the spiral groove, it is preferable that a blade acts on the developing roller surface to promote the replacing effect.

Fifteenth Embodiment

Figure 34:
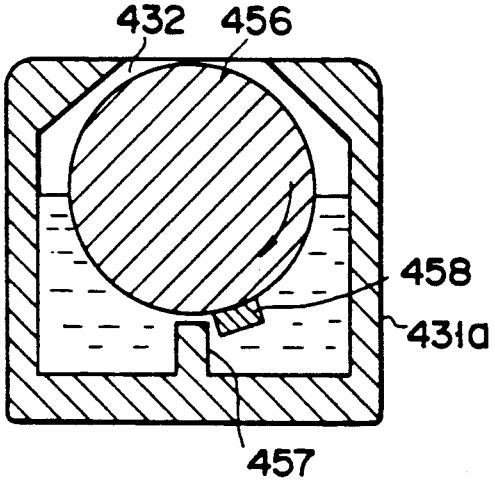
FIGS. 34 and 35 are views showing the fifteenth embodiment of the present invention.
Figure 35:
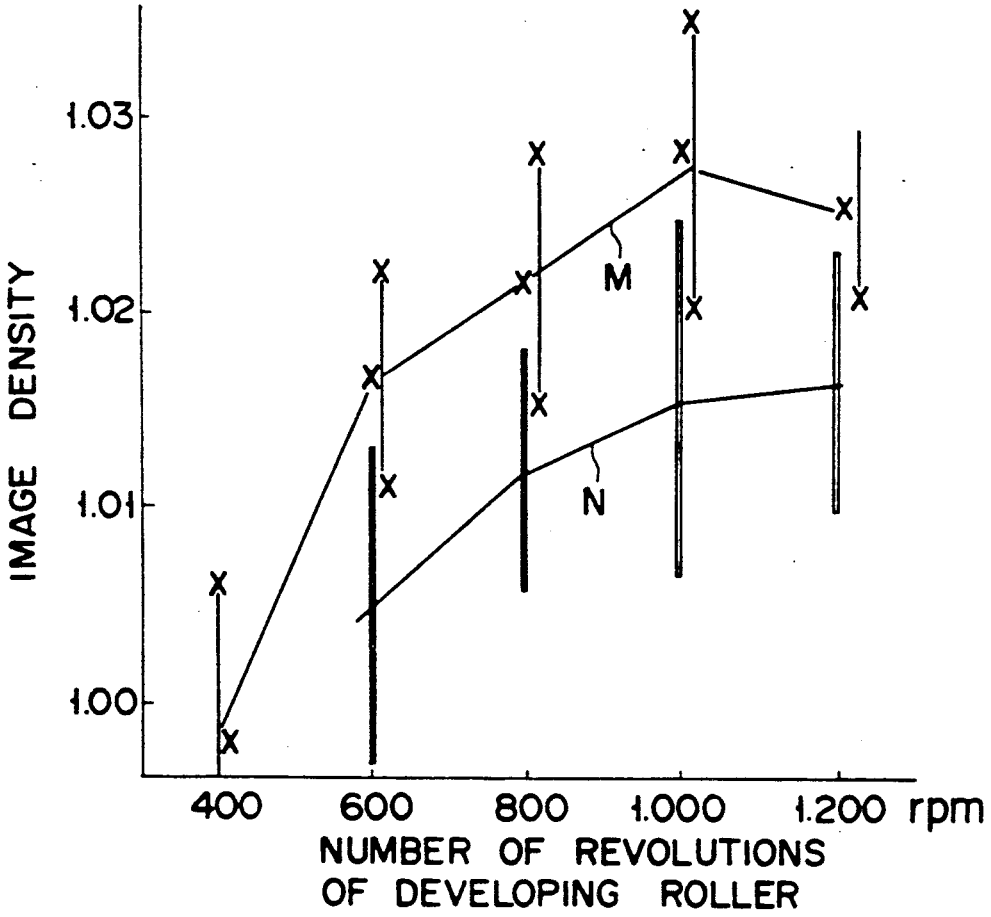

FIGS. 34 and 35 show the fifteenth embodiment of the present invention, in which the above-described improvement is realized. Referring to FIG. 34, reference numeral 456 denotes a developing roller; 457, a stopper; and 458, a magnet blade.

The developing roller 456 is made of a material which is conductive and is capable of magnetic attraction. Assume that groove formation processing applied to the outer surface of the developing roller 456 satisfies the requirements described with reference to FIGS. 26 to 28 or FIGS. 31 to 33. The stopper 457 is arranged below a developing solution level. The gap between the stopper 457 and the developing roller 456 is set to be smaller than the thickness of the magnet blade 458, i.e., a value for preventing the magnet blade 458 from passing through. The magnet blade 458 is constituted by a flexible magnet such as a rubber magnet. The magnet blade 458 is magnetically attracted to the outer surface of the developing roller 456 and uniformly acts on the roller 456 while properly conforming to bending and the like of the roller 456.

When the developing roller 456 is rotated in a direction indicated by an arrow, a developing operation is performed. Subsequently, when the outer surface of the roller 456, in which a developing solution having a toner consumed at a developing portion viscously adheres to the groove, reaches the blade 458, the developing solution in the groove is agitated or removed due to a scraping effect of the blade 458 or a viscous adhering effect. A fresh developing solution is replenished in the groove from a peripheral portion.

In order to confirm the effect of the blade 458 independently, a conventional developing roller was assembled in the developing apparatus having the arrangement shown in FIG. 24, a feed speed of a sheet-like recording medium was set to be 18 mm per second, and the developing roller was rotated at 400, 600, 800, 1,000, and 1,200 rpm, respectively. Developing was performed with or without the blade.

FIG. 35 shows a graph showing an experimental result, in which the axis of ordinate represents an image density, and the axis of abscissa represents the rotational speed of the developing roller 456. A curve N indicates a developing result without the blade 458, whereas a curve M indicates a developing result with the blade 458.

Referring to FIG. 35, each curve indicates an image density, and each vertical line indicates a standard deviation obtained from density measurement data at 10 points. It is apparent from the curves N and M that the image density is slightly increased with the blade. In addition, it is apparent from standard deviations that image density nonuniformity can be improved by the blade 458.

Furthermore, according to visual observation, in an image obtained when the blade 458 is used, an image density in a low-density region is greatly increased. As a result, developing streaks become less noticeable. Moreover, it i found that a smooth image having a uniform density as a whole can be obtained.

The blade 458 can be set at an arbitrary position, on the downstream side of the developing portion in the rotating direction of the developing roller 456, between a position where the roller surface escapes from the developing solution supply portion and a position where the roller surface reaches the developing portion.

In addition, the blade 458 may be constituted by an elastic rubber or plastic sheet or the like other than the magnet blade shown in FIG. 34. In this case, one end of the sheet is fixed, and the other end is elastically urged against the roller surface. Furthermore, the roller having an elastic surface may be urged against the developing roller 456 so as to be rotated upon rotation of the developing roller 456, or a sponge-like pad having a large compression distortion amount may be urged against the developing roller surface.

Sixteenth Embodiment

Figure 36:
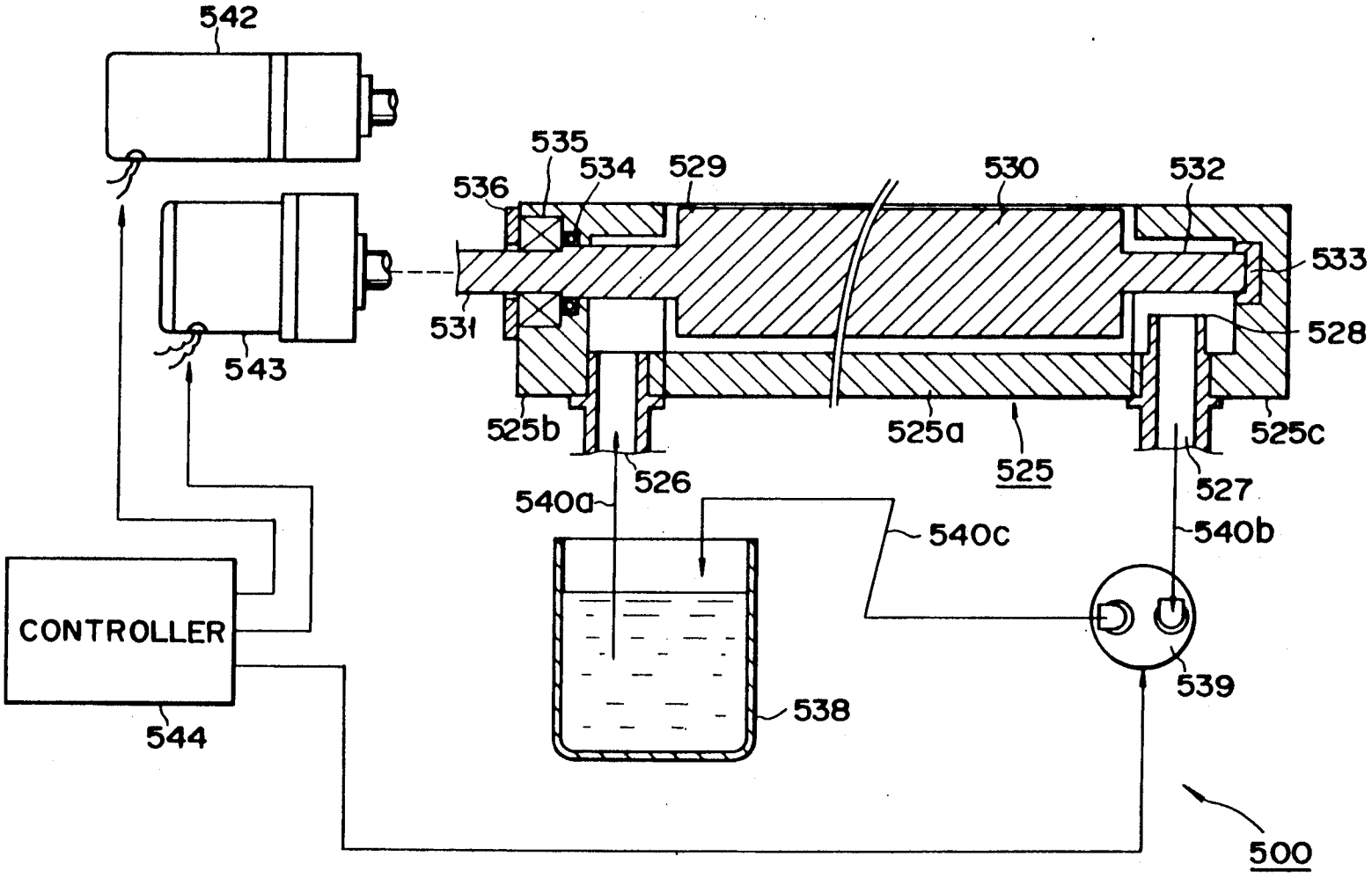
Figure 37:
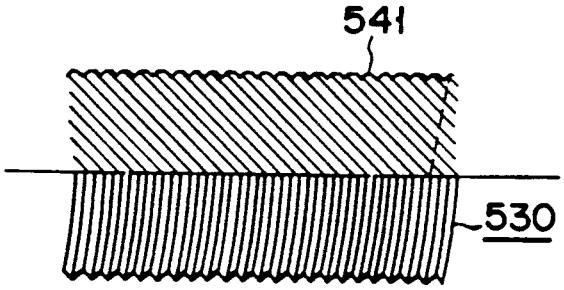
Figure 38:
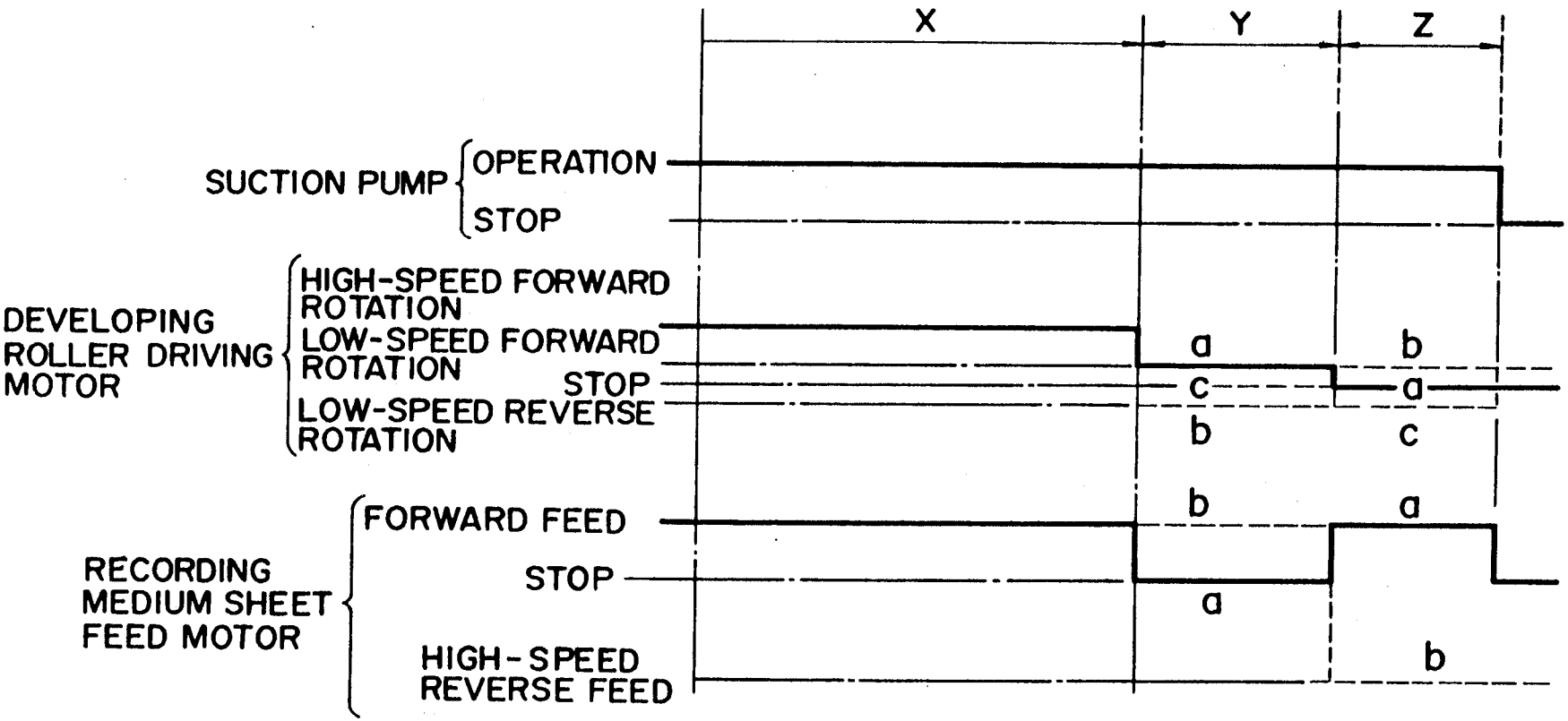

FIGS. 36, 37 and 38 show the sixteenth embodiment of the present invention. FIG. 36 is a view showing an overall arrangement of the apparatus 500. FIG. 37 is a half sectional view showing the developing roller 530. Referring to FIGS. 36 and 37, reference numeral 525 denotes a hollow case; 526, a developing solution supply port; 527, a discharge port; 528, a solution level regulating end; 529, a developing slit; 530, a developing roller; 531, a developing roller driving shaft; 532, a support shaft; 533, a bearing bush; 534, a seal ring; 535, a bearing; 536, a bearing stop; 538, a developing solution tank; 539, a suction pump; 540*a*, 540*b*, and 540*c*, piping tubes; 541, a spiral groove; 542, a sheet-like recording medium feed motor; 543, a developing roller driving motor; and 544, a controller.

The hollow case 525 comprises members 525*a*, 525*b*, and 525*c*. The end sealing members 525*b* and 525*c* are joined to the two end portions of the intermediate member 525*a*. Ease in assemblage is considered in this manner. However, divided portions can be arbitrarily changed. The hollow case 525 is sealed except for the developing solution supply port 526, the discharge port 527, and the developing slit 529. The upper end portion of the discharge port 527 extends upward from the bottom of the hollow case 525 and constitutes the solution level regulating end 528. The developing roller 530 is housed in the hollow case 525 such that the upper surface of the roller 530 is set at substantially the same height as that of the developing slit 529. One shaft 532 of the developing roller 530 is supported by the bush 533, whereas the other shaft 531 is supported by the bearing 535. The developing roller 530 is rotatably supported. An outwardly extended portion of the shaft 531 is coupled to the motor 543 to receive driving power. The seal ring 534 is used to maintain airtightness.

A spiral groove having a depth of about 0.3 to 0.6 mm is formed in the outer surface of the developing roller 530 along the circumferential direction. In a region where the top portions of the spiral groove is brought into contact with a sheet-like recording medium, a developing effect becomes sometimes insufficient. Therefore, in order to prevent developing streaks, the inclination angle of each groove is preferably increased with the groove pitch being set to be constant, like, e.g., multiple thread grooves.

The sheet-like recording medium feed motor 542 serves to feed the medium (not shown) in the forward direction (the feed direction during a developing operation) and in the reverse direction. Therefore, as the motor 542, a motor capable of controlling forward rotation (rotation in the direction during a developing operation), reverse rotation, and interruption of rotation and capable of controlling rotational speeds in the respective rotating directions is used.

The controller 544 controls operations of the suction pump 539, the sheet-like recording medium feed motor 542, and the developing roller driving motor 543 in accordance with operation sequence commands of the apparatus.

The developing solution tank 538 is connected to the developing solution supply port 526 through the piping tube 540*a*. The discharge port 527 is connected to the suction pump 539 through the piping tube 540*b*. The developing solution tank 538 is connected to the suction pump 539 through the piping tube 540*c*. The length of the developing slit 529 is set to be slightly smaller than the width of a sheet-like recording medium. When recording is to be performed, a sheet-like recording medium having an electrostatic latent image formed thereon is positioned to cover the developing slit 529.

When the suction pump 539 is operated, the sheet-like recording medium seals the developing slit 529 due to the effect of air flowing into the developing slit 529. Consequently, a negative pressure is generated in the hollow case 525. A developing solution is sucked up from the developing solution tank 538 by the effect of the negative pressure and flows into the hollow case 525. When the solution level rises and crosses over the solution level regulating end 528, a mixture of air and the developing solution flows out from the discharge port 527, and the proportion of the air is gradually decreased. The solution level stops rising when the air leaking from the small gap between the sheet-like recording medium and a peripheral surface of the developing slit 529 becomes equal in amount to the air discharged from the discharge port 527. Subsequently, the height of the solution level is stabilized.

Although the sheet-like recording medium is drawn by a negative pressure and receives a force for bending it inside the developing slit 529, the medium is supported by the top portions of the grooves formed in the developing roller 530 and is positioned. When the developing roller 530 is rotated, since the lower portion of the roller 530 is located below the developing solution level, the roller surface is covered with the developing solution by the viscous adhesive force of the solution. The solution is then carried to the developing portion in the middle of the developing slit 529. With an increase in rotational speed of the developing roller 530, the amount of solution carried on the outer surface of the developing roller 530 is increased. Subsequently, a solution pool is formed, due to the surface tension of the developing solution, on a portion where the sheet-like recording medium and top portion of spiral groove 541 are in contact with each other. The developing solution carried in recesses of the spiral groove 541 are efficiently supplied to the developing portion while the small gap is maintained by the recesses of the groove 541. The solution having a toner consumed upon developing is efficiently and forcibly carried away. In addition, the developing slit 529 is maintained at a negative pressure. For this reason, air leaks from small gaps between the peripheral upper surface of the slit 529 and the sheet-like recording medium and is taken into the slit 529. As a result, the developing solution with which the sheet-like recording medium surface is wet is sucked together with the air. Subsequently, the sheet-like recording medium surface which passes through the developing head portion is dried, and hence no developing solution is wastefully carried by the sheet-like recording medium to be consumed. In addition, this prevents a solvent from being gasified and contaminating the surroundings, and also prevents a developing solution from leaking and scattering from the developing head portion.

An operation sequence of each component during and after a developing operation will be described below with reference to FIG. 38. Referring to FIG. 38, the axis of abscissa represents an elapsed time; X, the developing step; Y, the solution pool removing step; and Z, the suction drying step.

The suction pump 539 is set in an operative state and a stop state and is ON/OFF-controlled upon energization of a pump such as a motor pump or an electromagnetic pump. A DC motor is preferably used as the developing roller driving motor 543, which is designed to be rotated at high and low speeds and to be stopped in the rotation direction during a developing operation or to be rotated at low speed in the reverse direction by switching voltages and polarities. A pulse motor, a servo motor, or the like is preferably used as the sheet-like recording medium feed motor 542, which is designed to be capable of high-speed rewind and feed operations and the like in the reverse direction.

In the developing step X, the suction pump 539 is in an operative state, the developing roller driving motor 543 is in a high-speed forward rotation state, and the sheet-like recording medium feed motor 542 is rotated at a predetermined speed in the forward direction.

When the developing operation is completed, the solution pool removing step Y is started. In this step, the suction pump 539 is continuously operated, but the developing roller driving motor 543 is shifted to a low-speed operation or stopped either in the forward direction or the reverse direction. The sheet-like recording medium feed motor 542 is stopped or continuously rotated in the forward direction.

When the developing roller 530 is stopped (c), the sheet-like recording medium feed motor 542 is preferably kept operated (b). When the developing roller 530 is stopped, the developing solution adhering to the developing roller surface drops through the recesses of the grooves 541. As a result, no developing solution is attached to at least the top portions of the groove 541. If the sheet-like recording medium is conveyed, a developing solution constituting a solution pool is carried by the medium and is removed. The medium is then sucked and dried by the negative pressure of the developing slit 529.

When the developing roller 530 is rotated at low speed in the forward direction (a) or in the reverse direction (b), a slight amount of developing solution adheres to the recesses of the grooves 541 of the roller 530 but does not adhere to the top portions while it is rotated, thus interrupting supply of the developing solution to the developing portion. Meanwhile, the developing solution constituting the solution pool is drawn into the groove 541 of the roller 530 and is carried away. It is preferable that the sheet-like recording medium is conveyed at this time because the medium serves to remove the solution pool. However, since a recording sheet portion conveyed for this purpose may sometimes be wastefully consumed, conveying of the medium may be stopped in order to prevent it.

In the suction drying step Z, the suction pump 539 is continuously operated. Meanwhile, the developing roller driving motor 543 is set in a stop state (a), in a low-speed forward rotation state (b), or in a low-speed reverse rotation state. The sheet-like recording medium feed motor 542 is set in a forward feed state (a) or in a high-seed rewind feed state (b).

Since the solution pool has been removed, it is only required that no new developing solution is supplied to the roller 530, as described above. The sheet-like recording medium is kept wet if the solution pool is simply removed therefrom. Therefore, after this operation, the sheet-like recording medium is moved to a position where it passes through above the developing slit 529 so as to be sucked/dried by the negative pressure effect.

In an apparatus for superposing images of different colors by reciprocating a sheet-like recording medium, such as a multipath type color printer, the medium is rewound after developing. If the suction drying step is performed simultaneously with the rewind step, the rewind time can be shortened, and a sheet-like recording medium portion to be wastefully consumed can be reduced. The rewind speed in the rewind step is not specifically limited. However, a high-speed rewind operation is normally performed to shorten the print time. Note that the recording medium is to be fed in the forward direction after developing of the final color is completed.

In the above description, control of rotation of the developing motor and of feed of a sheet-like recording medium are performed by direction control of the motor. However, the present invention can be executed by controlling an electromagnetic clutch or the like other than the motor.

Seventeenth Embodiment

An embodiment in which the effects of the present invention can be more reliably realized by causing a blade to come into contact with top portions of a spiral groove of a developing roller will be described below with reference to FIGS. 39 and 40.

Figure 39:
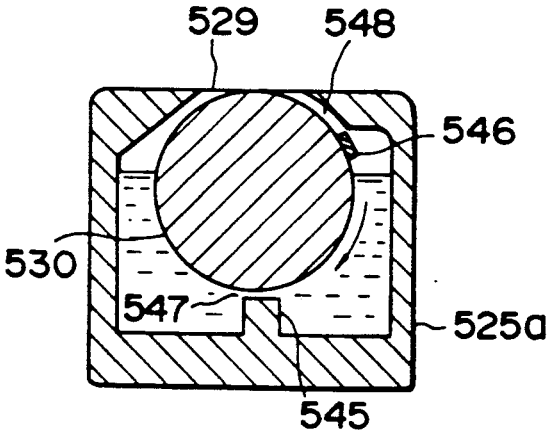

Referring to FIG. 39, reference numeral 545 denotes a stopper; 546, a magnet blade; 547, a lower stopper gap; an 548, an upper stopper gap.

A developing roller 530 is made of a magnetic metal. The groove is formed in the roller 530 along its circumferential direction. The magnet blade 546 is a flexible strip-like magnet obtained by dispersing a magnetic powder, e.g., ferrite, in a flexible binder material, e.g., a rubber magnet. The magnet blade 546 has the same length as that of the developing roller 530. The small gap 547 is defined between the stopper 545 and the developing roller 530 so as not to allow the magnet blade to pass therethrough. The upper gap 548 has a size allowing a developing solution carried by the developing roller 530 to pass through but inhibiting the magnet blade 546 to pass through. Note that while the magnet blade 546 is stopped by the upper gap 548, the blade 546 is located above a developing solution level.

During a developing operation, the developing roller 530 is rotated in a direction indicated by an arrow, and the magnet blade 546 is positioned by the stopper 545. The magnet blade is in contact with only top portions of the developing roller 530. However, since the depth of the groove is as small as about 0.1 to 0.5 mm, replacement of a developing solution in the groove with another developing solution portion is promoted by a viscous adhesive force between the blade and the developing solution and the effect of a turbulent flow caused near the blade.

If the developing roller 530 is rotated in the reverse direction, the magnet blade 546 is positioned by an end portion of the upper gap 548, and a developing solution adhering to the outer surface of the developing roller 530 is scraped off by the blade 546.

Note that the arrangement of the blade 546 is not limited to that of the magnet blade shown in FIG. 39. For example, a blade consisting of a rubber or plastic material is supported by a holder and is urged against the outer surface of a roller. In this case, the operating portion of the blade is to be set above a solution level on the downstream side of the developing portion.

Figure 40:
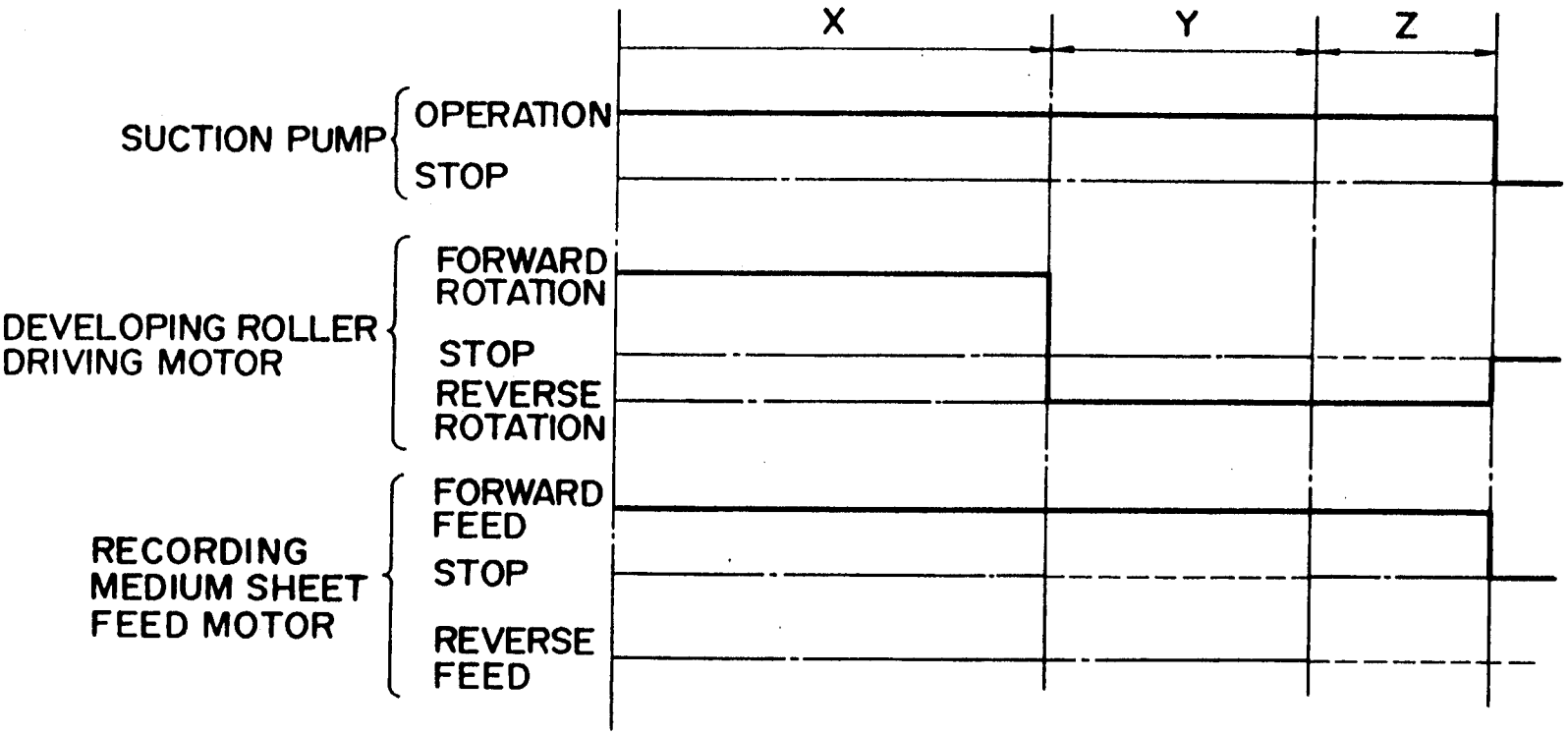

FIG. 40 is a view for explaining an operation sequence to be performed when the developing head shown in FIG. 39 is used. Reference symbols X, Y, and Z respectively have the same meanings as those described with reference to FIG. 38. The description made with reference to FIG. 38 is applied to driving operations of the developing pump, of the developing roller driving motor, and of the sheet-like recording medium feed motor in the developing step X. In the solution pool removing step Y upon completion of developing, the suction pump is continuously operated, and the developing roller 530 is rotated in the reverse direction. In this step, a sheet-like recording medium feed operation may be continued or stopped. If the developing roller 530 is rotated in the reverse direction, the magnet blade 546 is moved to a position above the developing solution level so as to remove the developing solution from the developing roller 530. At this time, the developing roller 530 may be rotated in the same manner as in a developing operation. However, if the roller 530 is rotated at a slightly lower speed, the developing solution removing effect of the blade 546 can more reliably act on the roller surface. In this embodiment, since the rotational speed of the roller 530 can be set to be higher than that of the roller shown in FIG. 36, a solution pool can be more quickly removed.

In the suction drying step Z, operations of the suction pump, of the developing roller, and of the sheet-like recording medium feed motor are the same as those described with reference to FIG. 36, and hence a description thereof will be omitted.

Eighteenth Embodiment

Figure 41:
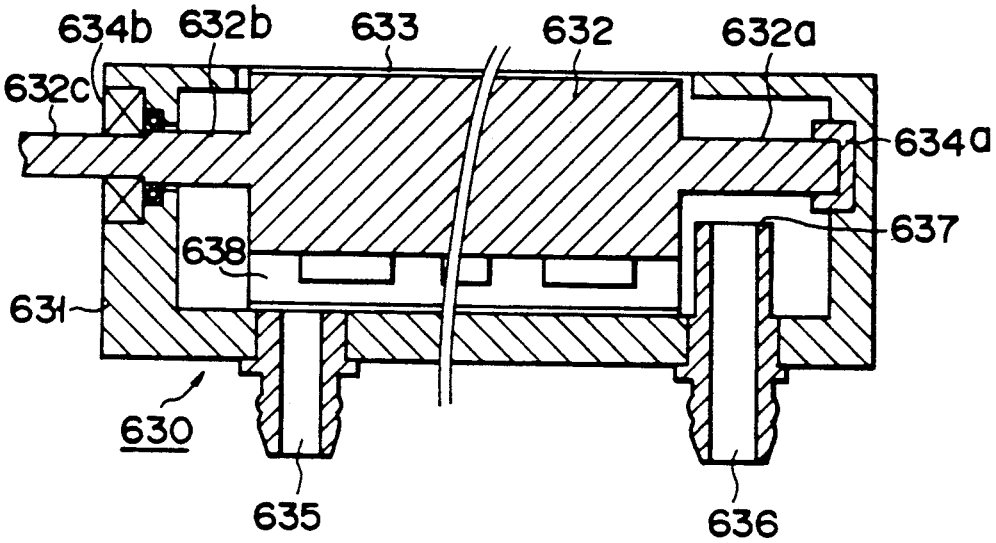
FIGS. 41 to 43 show the eighteenth embodiment of the present invention.
Figure 42:
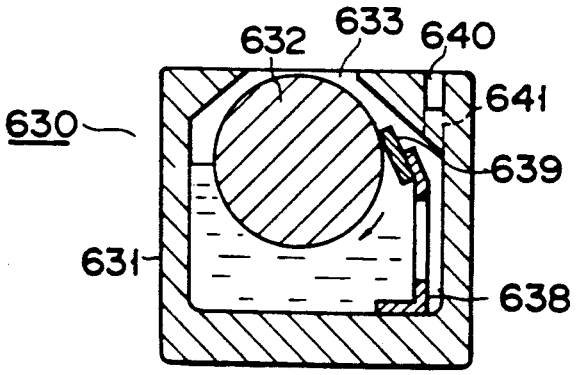
Figure 43:
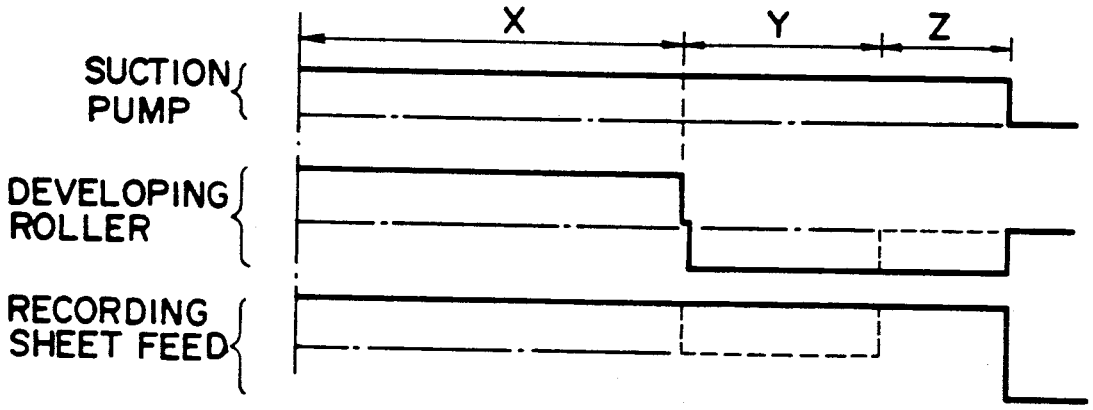

FIGS. 41 to 43 show the eighteenth embodiment of the present invention. FIG. 41 is a longitudinal front sectional view of a developing head 630. FIG. 42 is a longitudinal side sectional view of the developing head 630. FIG. 43 is a timing chart showing an operation of the overall developing apparatus.

Although the developing apparatus includes a suction pump, a developing solution tank, piping tubes, and the like in addition to the developing head 630, these components are not shown except for the developing head 630.

Referring to FIGS. 41 and 42, reference numeral 631 denotes a hollow case; 632, a developing roller; **632*a* and 632*b*, roller shafts; 632*c*, a roller driving shaft; 633, a developing slit; 634*a*, a bearing bush; 634*b*, a bearing with an O-ring; 635, a developing solution supply port; 636, a discharge port; 637, a solution level regulating end; 638, a blade support base; 639, a doctor blade; and 640**, a suction drying groove.

The developing solution supply port 635 is connected to a developing solution tank through a piping tube. The discharge port 636 is connected to the suction pump through a piping tube.

When the suction pump is operated while the developing slit 633 is covered with a recording medium having a width slightly larger than that of the developing slit 633, the developing slit 633 is sealed by the recording medium due to a negative pressure effect. As a result, a negative pressure is generated in the hollow case 631, and a developing solution is sucked up from the developing solution tank. The developing solution then flows into the hollow case 631 through the developing solution supply port 635. When the developing solution level is gradually raised to a position above the upper surface of the solution level regulating end 637, the developing solution and air flow out from an opening of the solution level regulating end 637. When the amount of air flowing out from the hollow case 631 becomes equal to the amount of air leaking into the case 631 from the developing slit 633, the developing solution level does not rise any more.

Meanwhile, the developing roller 632 is rotated in a direction indicated by an arrow. At this time, a solution film is formed on the roller surface by viscosity of the developing solution, and the solution film is brought into contact with a recording medium surface in the middle of the developing slit 633 to form a solution pool. As a result, electrophoresis of a toner occurs to perform developing due to a strong potential gradient caused by an electrostatic latent image.

The developing solution having the toner consumed is carried on the roller surface to be moved and is forcibly scraped off by the blade 639. When the roller surface is moved below the solution level again, a new developing solution adheres to the roller surface.

FIG. 43 is a timing chart showing an operation of the developing apparatus during and after a developing operation. Referring to FIG. 43, reference symbol X in the direction of the axis of abscissa denotes a developing step; Y, a solution pool removing step; and Z, a suction drying step. In addition, the steps Y and Z are the steps of removing a developing solution after a developing operation.

During a developing operation, the suction pump is operated, and the developing roller 632 is rotated in the direction indicated by the arrow to convey the recording medium in the right direction in FIG. 42. At this time, the developing slit 633 is set at a negative pressure, and air leaks and flows in through small gaps defined between the recording medium and the outer surface of the developing head 630. The developing solution adhering to the recording medium is sucked into the developing slit 633 along this air flow. Therefore, when the recording medium passes through the developing head 630, it is almost dried. Note that the recording medium is more reliably dried by the suction drying effect of the suction drying groove 640.

When developing in a predetermined region is completed, the developing roller 632 is rotated in the direction opposite to the direction indicated by the arrow in order to remove the solution pool formed between the developing roller 632 and the recording medium. A developing solution adhering to the developing roller 632 is scraped off by the doctor blade 639, and a developing solution is carried away from the solution pool by a roller surface having no developing solution attached thereto. Conveying of the recording medium may be continued during this period. However, if it is stopped, a recording surface portion to be wastefully consumed can be reduced.

When the recording medium is conveyed in the right direction after the solution pool is removed, the developing solution adhering to the recording surface is removed by the suction effect of the developing slit 633. The developing roller 632 may be stopped during this period or may be rotated in the direction opposite to the rotating direction during the developing operation.

When the suction pump is stopped upon completion of the drying step, the pressure of the hollow case 631 is restored to the atmospheric pressure, and a suction state of the recording medium is canceled. As a result, the developing solution in the developing head 630 returns to the tank through the supply port 635.

In the above-described embodiment, for example, the doctor blade 639 is used as a means for forcibly removing a developing solution adhering to the outer surface of the developing roller 632. At the end of developing, an operating portion of this removing means, i.e., a portion where the blade 639 and the roller 632 come into contact with each other, is exposed on the solution level. At this time, the developing roller 632 is rotated in a direction in which the roller surface moves from the operating portion to the developing portion, i.e., a solution pool, without passing through a position below the solution level. After the solution pool is removed from the developing portion, the suction pump is kept operated until a recording surface portion having a developing solution attached thereto completely passes through the developing head portion. The present invention can be variously changed as will be described below.

Nineteenth Embodiment

Figure 44:
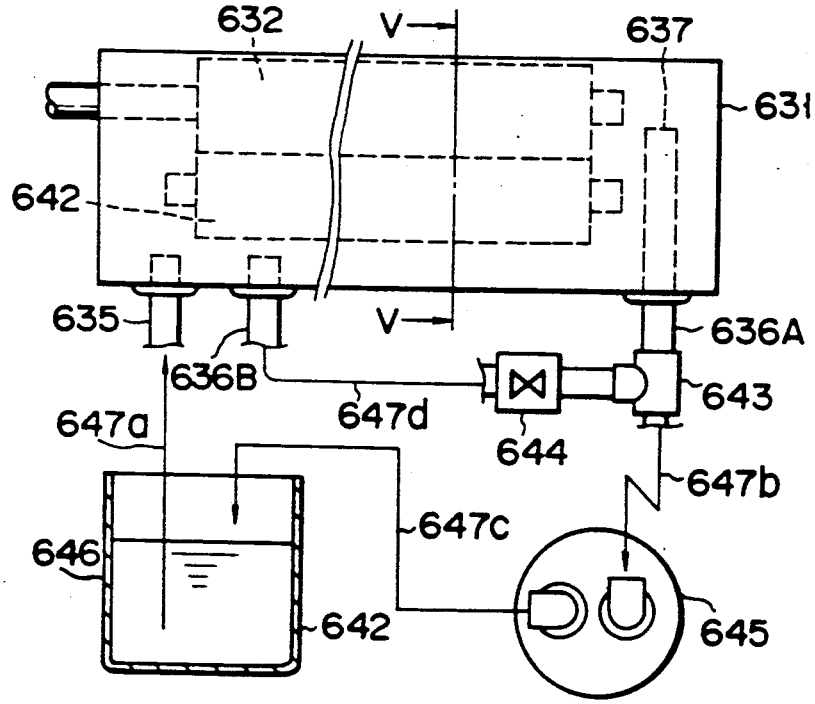
FIGS. 44 to 46 are views showing the nineteenth embodiment present invention.
Figure 45:
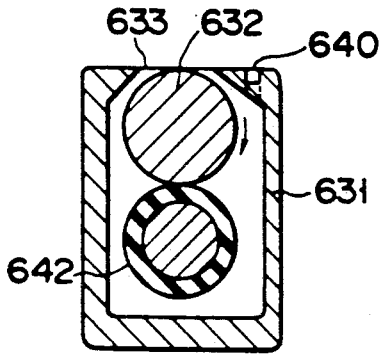
Figure 46:
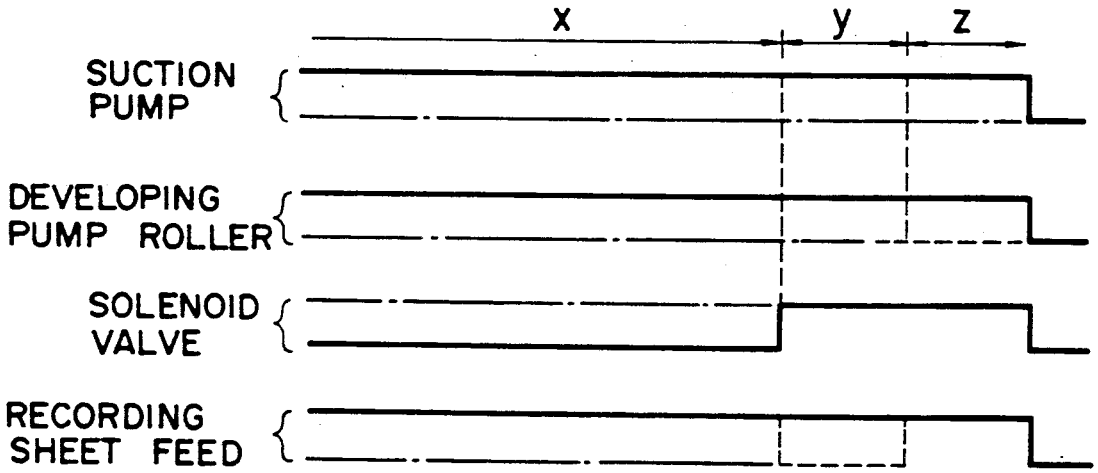

FIGS. 44 to 46 show the nineteenth embodiment of the present invention. This embodiment includes a means for changing the solution level in a developing head. With this means, while a developing solution level is lowered to a position sufficiently lower than an operating position of the means for forcibly removing a developing solution from the outer surface of a developing roller 632, the developing roller 632 is rotated to remove a solution pool from a developing portion.

Referring to FIG. 44, reference numeral 636A denotes a first discharge port; 636B, a second discharge port; 642, an elastic roller; 643, a T joint; 644, a solenoid valve; 645, a suction pump; 646, a developing solution tank; and **647*a* to 647*d***, piping tubes.

When developing is to be started, the suction pump 645 is operated while the developing slit 633 is covered with a recording medium. Note that the solenoid valve 644 is closed at this time. A negative pressure is generated in the hollow case 631, and a developing solution is sucked up from the developing solution tank 646. The developing solution flows in from the developing solution supply port 635 and fills the hollow case 631 to a height determined by the solution level regulating end 637. The solution further flows out from the first discharge port 636A and reaches the suction pump 645. When the developing roller 632 is rotated, the developing solution is carried by the outer surface of the roller 632 so as to act on the sheet-like recording medium surface, thus performing developing. The solution having a toner consumed upon developing and attached to the roller surface due to viscosity is forcibly removed by the effect of the elastic roller 642 which is urged against the developing roller 632 and is rotated upon rotation thereof.

When the sheet-like recording medium is conveyed in the right direction in FIG. 45 and passes through above the developing slit 633, the medium is dried because of the negative pressure.

FIG. 46 shows an operation sequence of each component after developing. When developing in a predetermined region is completed, the solenoid valve 644 is opened. As a result, a solution path is formed to extend from the second discharge port 636 to the T joint 643 through the piping tube **647*d* and the solenoid valve 644. Since the discharge port 636B has an inflow port in the bottom of the hollow case 631, the developing solution level is abruptly lowered, and the nip portion between the developing roller 632 and the elastic roller 642, i.e., the operating portion of the developing solution removing means, is exposed above the solution level. If the developing roller 632 is continuously rotated, the outer surface of the developing roller 632 escapes from the nip portion while the developing solution is removed therefrom by the elastic roller 642. In addition, the outer surface of the developing roller 632 is moved to a position to oppose the sheet-like recording medium without supplying a developing solution thereto, and hence the roller 632** acts to carry away a developing solution from a solution pool on the sheet-like recording medium surface. During this period, the sheet-like recording medium may be stopped.

After the solution pool is removed, the sheet-like recording medium is conveyed in the right direction to remove the developing solution with which the sheet-like recording medium surface is wet. With this operation, the entire developing solution adhering to the surface of the sheet-like recording medium is sucked and removed. Thereafter, the pump 645 is stopped to complete all the steps associated with developing. Referring to FIG. 46, reference symbol X denotes a developing step; Y, a solution pool removing step; and Z, a suction drying step.

In the nineteenth embodiments, the operating position of the means for forcibly removing a developing solution is fixed. Where a means having a variable operating position is to be used, the present invention can be executed by moving its operating position to a position above a solution level after developing.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A roller type liquid developing apparatus comprising:

a developing solution tank for storing a developing solution in which charged fine color particles are dispersed;

a developing head for applying the developing solution stored in said developing tank to a sheet-like recording medium so as to develop an electrostatic latent image formed on the sheet-like recording medium; and a suction pump for pumping up the developing solution from said developing solution tank and supplying the solution into said developing head by a negative pressure effect, and subsequently circulating the developing solution into said developing solution tank, wherein said developing head comprises a rod-like base, a developing slit comprising an elongated opening formed in a surface of said rod-like base which corresponds to the sheet-like recording medium and said developing slit having a length smaller than a width of the sheet-like recording medium, a hollow portion, formed to be continuous with said developing slit, for receiving the developing solution from said developing solution tank, and a developing roller which is arranged in said hollow portion so as to be rotated while an outer surface of said developing roller opposes an opening end of said developing slit;

said developing roller capable of carrying the developing solution on the outer surface thereof;

a liquid suction slit having a bottom portion formed in an upper surface of said rod-like base to be adjacent to said developing slit;

a communicating hole, having a small cross-sectional area, for causing said bottom portion of said liquid suction slit to communicate with a negative pressure from said pump; and a separating slit formed between said developing slit and said liquid suction slit so as to be partly kept open to the air.

2. A roller type liquid developing apparatus comprising:

a developing solution tank for storing a developing solution in which charged fine color particles are dispersed;

a developing head for applying the developing solution stored in said developing tank to a sheet-like recording medium so as to develop an electrostatic latent image formed on the sheet-like recording medium; and a suction pump for pumping up the developing solution from said developing solution tank and supplying the solution into said developing head by a negative pressure effect, and subsequently circulating the developing solution into said developing solution tank, wherein said developing head comprises a rod-like base, a developing slit comprising an elongated opening formed in a surface of said rod-like base which corresponds to the sheet-like recording medium and said developing slit having a length smaller than a width of the sheet-like recording medium, a hollow portion, formed to be continuous with said developing slit, for receiving the developing solution from said developing solution tank, and a developing roller which is arranged in said hollow portion so as to be rotated while an outer surface of said developing roller opposes an opening end of said developing slit said developing roller capable of carrying the developing solution on the outer surface thereof;

said developing roller including a magnetic material;

a blade which is formed by magnetizing a strip-like magnetic sheet obtained by dispersing magnetic particles in an elastic member so as to be attracted and held on said outer surface of said developing roller by a magnetic attracting force; and a blade stopper for positioning said blade, arranged between a position of a downstream end portion of a developing portion in said developing slit in he direction of rotation of said developing roller and a position where said outer surface of said developing roller rotates out of said developing solution and moves toward an upstream end portion of said developing portion.

3. A roller type liquid developing apparatus comprising:

a developing solution tank for storing a developing solution in which charged fine color particles are dispersed;

a developing head for applying the developing solution stored in said developing tank to a sheet-like recording medium so as to develop an electrostatic latent image formed on the sheet-like recording medium; and a suction pump for pumping up the developing solution from said developing solution tank and supplying the solution into said developing head by a negative pressure effect, and subsequently circulating the developing solution into said developing solution tank, wherein said developing head comprises a rod-like base, a developing slit comprising an elongated opening formed in a surface of said rod-like base which corresponds to the sheet-like recording medium and said developing slit having a length smaller than a width of the sheet-like recording medium, a hollow portion, formed to be continuous with said developing slit, for receiving the developing solution from said developing solution tank, and a developing roller which is arranged in said hollow portion so as to be rotated while an outer surface of said developing roller opposes an opening end of said developing slit said developing roller capable of carrying the developing solution on the outer surface thereof;

a developing roller including a magnetic material;

a roller position regulating member arranged to allow a regulating surface thereof to come into contact with said outer surface of said developing roller at a predetermined position; and means for positioning said developing roller so as to allow said developing roller to be slidably rotated on the regulating surface such that said outer surface of said developing roller is magnetically attracted to the regulating surface of said roller position regulating member.

4. A roller type liquid developing apparatus comprising:

a developing solution tank for storing a developing solution in which charged fine color particles are dispersed;

a developing head including a hollow case and a developing roller having an outer surface with a spiral groove formed in said outer surface, said hollow case having a developing solution supply port and a discharge port in a bottom portion thereof and having a developing slit in an upper surface thereof, and said developing roller being rotatably arranged in said hollow case while said outer surface of said developing roller which has said spiral groove formed thereon opposes a sheet-like recording medium through a small gap, and the outer surface of said developing roller opposes an opening end of said developing slit, whereby the developing solution stored in said developing solution tank is applied to the recording medium at a developing portion so as to develop an electrostatic latent image formed on the recording medium;

a suction pump for pumping up the developing solution from said developing solution tank and supplying the solution into said developing head, and subsequently circulating the developing solution to said developing solution tank;

a developing roller driving unit for rotating said developing roller to said developing head;

a recording medium feed unit for conveying the sheet-like recording medium so as to cause the medium to pass over said developing head; and control means for controlling said suction pump, said developing roller driving unit, and said recording medium feed unit, wherein said control means controls rotation of said developing roller in a first mode during a developing operation and in a second mode, different from said first mode while said suction pump is operated to remove the developing solution from said outer surface of said developing roller upon completion of developing, and said control means controlling the conveyance of the sheet-like recording medium so as to remove the developing solution from a surface of the recording medium and dry said recording surface of the sheet-like recording medium.

5. An apparatus according to claim 4, further comprising means for stopping said developing roller and conveying the sheet-like recording medium upon completion of developing.

6. An apparatus according to claim 4, further comprising means for rotating said developing roller at a first speed during a developing operation and at a second speed lower than said first speed when developing is completed.

7. An apparatus according to claim 4, further comprising:

a doctor blade which is arranged at a position of a developing solution level on the downstream side of the developing portion in a rotating direction of said developing roller; and means for rotating said developing roller in a first direction during a developing operation and in a second direction, opposite to said first direction, after developing is completed.

8. An apparatus according to claim 4, further comprising:

developing solution forcibly removing means for forcibly removing a developing solution adhering to said outer surface of said developing roller;

means for exposing an operating position of said developing solution forcibly removing means above a solution level upon completion of developing;

means for rotating said developing roller in a direction in which a roller surface moves to the developing portion without moving from the exposed operating position of said developing solution forcibly removing means and passing through a position below the solution level; and means for continuously operating said suction pump during a period in which a portion of the sheet-like recording medium to which a developing solution adheres completely passes through a position of said developing head after a developing solution pool is removed from the developing portion.

9. An apparatus according to claim 8, further comprising:

means for setting an operating position of said developing solution forcibly removing means on the roller surface to be above the developing solution level;

means for rotating said developing roller in a first direction in which the roller surface passes through the operating position of said developing solution forcibly removing means and reaches the developing portion through a position below the developing solution level during a developing operation; and means for rotating said developing roller in a second direction opposite said first direction when developing is completed.

10. An apparatus according to claim 8, further comprising:

solution level changing means for changing a developing solution level in said developing head;

means for raising the developing solution level to a height enough to supply a developing solution to an outer surface of said developing roller during a developing operation by using said solution surface level changing means; and means for lowering the developing solution level to a position sufficiently lower than the operating position of said developing solution forcibly removing means upon completion of developing by using said solution level changing means.

11. An apparatus according to claim 8, further comprising:

means for rotating said developing roller in a first forward direction during a developing operation so as to set the operating position of said developing solution forcibly removing means to a position lower than the developing solution level; and means for rotating said developing roller in a second direction opposite to said first forward direction upon completion of developing so as to set the operation position of said developing solution forcibly removing means to a position higher than the developing solution level.

12. A roller type liquid developing apparatus. in which the liquid developing apparatus develops a sheet-like recording medium having a given width and having an electrostatic latent image formed on a first surface thereof, comprising:

a developing solution tank;

a developing solution, having charged fine colored particles dispersed therein, stored in said developing solution tank;

a developing head for applying said developing solution stored in said developing solution tank to said first surface of said sheet-like recording medium to develop said electrostatic latent image; and supply path means for supplying developing solution from said developing solution tank to said developing head;

a pump for supplying suction pressure to suck up said developing solution from said developing solution tank into said supply path means and for supplying said suction pressure to said developing head and said first surface of said sheet like recording medium after said latent image is developed, to such up said developing solution used to develop said latent image back into said developing solution tank, and to immediately dry said first surface of said sheet-like recording medium;

said developing head comprising:

a rod-like base having a preselected length and at least one flat surface for mounting said sheet-like recording medium thereon;

a hollow portion formed in said rod-like base along said preselected length of said rod like base;

said hollow portion being provided with said suction pressure and receiving said sucked up developing solution from said supply path means;

a developing slit including an elongated opening formed between said hollow portion and said at least one flat surface of said rod-like base for supplying developing solution to said first surface of said sheet-like recording medium, said developing slit also being provided with said suction pressure when said hollow portion is provided with said suction pressure;

said developing slit having a length smaller than said width of said sheet-like recording medium;

said developing slit being substantially sealed by said sheet-like recording medium when said sheet-like recording medium is mounted on said at least one flat surface of said rod-like base as said suction pressure of said pump sucks up said developing solution and said suction pressure is provided to said developing slit;

a rotatable roller rotatable in a given direction mounted in said hollow portion, said rotatable roller including first and second end portions and a cylindrical surface formed between said first and second end portions;

said roller being positioned in said hollow portion of said rod-like base adjacent said developing slit such that upon rotation of said developing roller in said given direction when said pump is sucking up said developing fluid and said sheet-like recording medium substantially seals said developing slit as a result of said suction pressure, said cylindrical surface of said roller carries at least some of said sucked up developing fluid to said first surface of said sheet-like recording medium, which is substantially sealing said developing slit, to develop said latent image;

13. The apparatus according to claim 12, in which said sheet-like recording medium moves across said at least one flat surface of said rod-like base in a given direction across said developing slit, further comprising:

a liquid suction slit formed in said at least one flat surface of said rod-like base adjacent to said developing slit;

said liquid suction slit having a bottom portion communicating with said hollow portion formed in said rod-like base; and an aperture, having a small sectional area formed between said bottom portion of said liquid suction slit and said pump to enable said liquid suction slit to suck up developing fluid on said at least one flat surface of said rod-like base.

14. The apparatus according to claim 12 in which said developing roller has a longitudinal axis, further comprising:

a developing solution carrying spiral groove formed on said cylindrical surface of said developing roller forming peaks and valleys on said cylindrical surface, and which groove is substantially filled with said developing solution;

said spiral groove having a predetermined groove pitch and being formed to support said first surface of said sheet-like recording medium on said peaks on said cylindrical surface;

a line having a dimension l1 defining high density image forming regions on said sheet-like recording medium adjacent each of said peaks;

the cross-sectional shape of said groove being formed such that said line having said dimension l1 measured along the sheet-like recording medium in a direction parallel to said longitudinal axis of said developing roller is defined to include all points on said recording medium having a distance between an inner wall of the groove and said first surface of the sheet-like recording medium which is not more than 0.2 mm; and the line having said dimension l1 is set to be not less than ½ of said predetermined groove pitch as measured along said longitudinal axis of said developing roller so that lines having said dimensions l1 around adjacent peaks will touch or overlap, thereby eliminating streaking resulting from low density developing regions between said peaks.

15. The apparatus according to claim 12, wherein said developing roller is formed of metal, further comprising energization means for energizing said developing roller to enable said developing roller to function as a developing electrode.

16. An apparatus according to claim 14, further comprising a developing roller having a spiral groove formed in a surface of a developing roller base, the groove comprising a multiple thread groove having a lead angle of not more than 30°.

17. An apparatus according to claim 14, further comprising a doctor blade which is arranged between a position of a downstream end portion of a developing portion in said developing slit in the rotating direction of said developing roller and a position where the outer surface of said developing roller escapes from a developing solution level to move toward an upstream end portion of the developing portion and is brought into contact with the top portion of the spiral groove of said developing roller.

* * * * *